US005523829A

United States Patent [19]

Miyashiro et al.

[11] Patent Number: 5,523,829

[45] Date of Patent: Jun. 4, 1996

[54] IMAGE FORMING APPARATUS HAVING RECORDING MATERIAL CARRYING MEMBER

[75] Inventors: Toshiaki Miyashiro, Ichikawa; Haruo Fujii; Motoi Katoh, both of Yokohama; Tatsuya Kobayashi, Sohka; Tetsuya Kobayashi, Kawasaki; Akira Ito, Tokyo; Naoki Enomoto; Akihiko Uchiyama, both of Yokohama; Yoshiro Saito, Kawasaki, all of Japan

[73] Assignee: Canon Kabushiki Kaisha, Tokyo, Japan

[21] Appl. No.: 127,604

[22] Filed: Sep. 28, 1993

[30] Foreign Application Priority Data

Sep. 29, 1992 [JP] Japan ..... 4-283815

[51] Int. Cl.[6] ..... G03G 15/01; G03G 15/14; G03G 15/20

[52] U.S. Cl. ..... 355/271; 355/282; 355/326 R

[58] Field of Search ..... 355/271, 274, 355/282, 326 R, 327

[56] References Cited

U.S. PATENT DOCUMENTS

| | | | |
|---|---|---|---|
| 3,963,341 | 6/1976 | Tully | 355/4 |
| 4,872,037 | 10/1989 | Kasahara et al. | 355/271 |
| 4,873,541 | 10/1989 | Hirose et al. | 346/153.1 X |
| 5,040,026 | 8/1991 | Jamzodeh et al. | 355/271 |
| 5,043,761 | 8/1991 | Johnson | 355/271 X |
| 5,091,751 | 2/1992 | Inoue et al. | 355/274 |
| 5,099,286 | 3/1992 | Nishise et al. | 355/271 X |
| 5,214,480 | 5/1993 | Aoki et al. | 355/274 |
| 5,225,852 | 7/1993 | Uchida et al. | 346/134 |
| 5,249,023 | 9/1993 | Miyashiro et al. | 355/273 |
| 5,260,751 | 11/1993 | Inomata | 355/271 |

FOREIGN PATENT DOCUMENTS

| | | |
|---|---|---|
| 2558615 | 7/1976 | Germany . |
| 2558615A | 7/1986 | Germany . |
| 63023174 | 6/1976 | Japan . |
| 1248171 | 10/1989 | Japan . |
| 4001670 | 1/1992 | Japan . |
| WO9114209 | 9/1991 | WIPO . |

*Primary Examiner*—Fred L. Braun

*Attorney, Agent, or Firm*—Fitzpatrick, Cella, Harper & Scinto

[57] ABSTRACT

An image recording apparatus includes an image bearing member; a recording material carrying member for carrying a recording material to a transfer position for transfer of an image; a moving device for imparting relative movement between the image bearing member and the recording material carrying member; and a recess in the recording material carrying member for permitting the image bearing member and the recording material carrying member to face each other without contact therebetween. The recording material feeding speed is switched from a first speed different from the fixing speed to a second speed substantially the same so that when it imparts the approaching relative movement, the peripheral speeds of the recording material carrying member and image bearing member are substantially equal immediately before they contact.

43 Claims, 15 Drawing Sheets

IMAGE FORMING APPARATUS HAVING RECORDING MATERIAL CARRYING MEMBER

FIELD OF THE INVENTION AND RELATED ART

The present invention relates to an image forming apparatus such as an electrophotographic or electrostatic recording type copying machine or printer, and it is particularly suitable for a color image forming apparatus in which visualized images (toner images) having different colors are sequentially superposedly transferred onto the same recording material to provide a full-color image or multi-color image.

In widely used conventional color image forming apparatus, there are provided a plurality of developing devices containing different color developers (toners), and the charging, exposure, developing and transfer steps are sequentially carried out through an electrophotographic process to form a full-color or multi-color image through a plurality of recording cycles. Among such color image forming apparatuses of the conventional electrophotographic type, the description will be made as to a color image forming apparatus having a transfer drum wherein a multi-color image is formed through a plurality of recording cycles.

The toner image formed on the photosensitive drum functioning as an image bearing member is transferred onto a recording material carried on a transfer drum functioning as a recording material carrying member.

When a full-color image is to be formed on a recording material, a plurality of toner images are formed one-by-one color on the photosensitive drum, and the toner image is superposedly transferred one-by-one on the recording material carried on the transfer drum. After the transfer operation, the recording material is separated from the transfer drum, and thereafter, is conveyed to a fixing device, in which the superposed toner images on the recording material are fused and color-mixed to provide a fixed full-color image on the recording material.

As for the recording material used in the color image forming apparatus, plain paper such as cut plain sheet or the like is normally used. However, OHT (overhead transparence) or another non-plain-paper sheet (non-standard) is used. When such non-plain-paper sheet is used in the fixing device of the above-described color image forming apparatus, the developer is fused for the coloring, and therefore, the thermal capacity of the recording material is significantly influential to the image quality after the image fixing. Particularly, the plain paper and the non-plain-paper paper have remarkably different thermal capacities. In order to obtain the usable transparency of the OHT sheet, the required heat quantity is several times that required by the paper having the same thickness. For this reason, when the recording material is such a non-plain-paper sheet, in the above-described color image forming apparatus, a recording material discriminating means such as sensor or the like is disposed in a recording material feeding passage between the sheet feeding cassette and the transfer drum to permit detection of the material of the recording material beforehand. Then, the feeding speed of the recording material feeding means for feeding the recording material to the fixing device and the fixing speed of the fixing device (the fixing roller rotational speed or the like), are made variable, so that the fixing period is increased to provide the heat capacity required for the fixing of the image on the non-plain-paper sheet.

However, in order to reduce the speed of the recording material separated from the transfer drum between the transfer drum and the fixing device without formation of a loop possibly resulting in the image rubbing, the distance L between a recording material separating position (recording material separator) for separating the recording material from the transfer drum and a fixing device inlet at which the recording material enters the fixing device, is required to be longer than a length L0 of the maximum non-plain-paper sheet usable in the color image forming apparatus. Therefore, the above-described method needs a large space for the recording material conveyance, with the result of bulky apparatus. This is disadvantageous.

In order to solve this problem, there have been proposed a method in which the length of the recording material conveying portion is shortened than the length required as described above, and the temperature of the fixing device is controlled at all times at the proper level for the non-plain-paper sheet, and a method in which the fixing temperature is increased only at the time of the passage of the non-plain-paper sheet. However, in these methods, the temperature of the fixing device rises abnormally, and therefore, the material of silicone rubber or the like constituting the fixing roller may be deteriorated with the result of significant shortening of the service life of the fixing device. This is disadvantageous.

In another proposed method, the image forming period, that is, the process speed (the peripheral speed of the photosensitive drum) of the color image forming apparatus is reduced to a speed suitable for the proper fixing on the non-plain-paper sheet. However, if this method is used, the writing timing or signal for forming the electrostatic latent image on the photosensitive drum is required to be changed in accordance with the process speed with the result of complicated and expensive apparatus. This is disadvantageous.

It is known that a toner image is transferred onto a recording material carried on the transfer drum from the photosensitive drum is transferred at a transfer position, and thereafter, the recording material having the toner image is passed through the transfer position again without image transfer operation. In this case, in order to prevent the offset of the toner image from the recording material back onto the photosensitive drum, the photosensitive drum and the transfer drum are spaced from each other to prevent the contact between the photosensitive drum and the recording material.

However, in the conventional image forming apparatus, the recording material and the image bearing member are disposed with a small cap (approx. 100 microns) or with proper nip pressure, and therefore, when the recording material carrying member is brought back to the image bearing member to restore the normal image forming condition, they are contacted to each other with the result of an impact, which will lead to the strong rubbing between the recording material carrying member and the image bearing member. If this occurs, the surfaces thereof are damaged mutually.

Particularly, when the recording material carrying member is in the form of a solid drum, it is contacted to the image bearing member with the depth of interference of several hundreds microns to several mm, and therefore, the recording material carrying member and the image bearing member are more strongly depressed with each other than in the case of the recording material carrying member in the form of a cut-away drum. Therefore, the recording material carrying member or the image bearing member are more quickly deteriorated than in the case of the cut-away drum. Here, the solid drum means a drum of which the entire area for carrying the recording material is of a laminated structure constituted by an electrically conductive layer and a dielectric layer. The cut-away drum is a drum comprising a pair of opposing rings which are connected by a connecting portion to constitute a cylinder a part of which is cut away, and the cut-away portion is covered with a dielectric sheet.

The deteriorations of the recording material carrying member and the image bearing member arise in the following manner. In the case that the rotational speed Vp of the image bearing member and the rotational speed Vtr of the recording material carrying member are different from each other at the time when the recording material carrying member returns to a regular image forming position, that is, the position at which the transfer of the visualized image is carried out, friction force or another unnecessary force are applied to the recording material carrying member and/or the image bearing member so as to eliminate the speed difference $\delta V$.

Since the recording material is brought into contact to the image bearing member when the recording material returns to the regular position, the rotation of the image bearing member is slightly vibrated by the impact upon the restoration. The vibration is reflected as it is on the latent image formed on the image bearing member thereafter. This disturbs the formed image.

SUMMARY OF THE INVENTION

Accordingly, it is a principal object of the present invention to provide an image forming apparatus in which the impact is prevented when the recording material carrying member and the image bearing member are contacted.

It is another object of the present invention to provide an image forming apparatus in which the deterioration of the image bearing member and/or the recording material carrying member are effectively prevented.

It is a further object of the present invention to provide an image forming apparatus in which no friction is produced when the recording material carrying member and the image bearing member are contacted to each other.

It is a further object of the present invention to provide an image forming apparatus to prevent disturbance of the latent image formation on the image bearing member when the recording material carrying member and the image bearing member are brought into contact with each other.

It is a yet further object of the present invention to provide an image forming apparatus capable of effecting proper image fixing operation irrespective of the material of the recording material.

It is a further object of the present invention to provide an image forming apparatus in which the distance between a recording material separating position and an image fixing position is shortened so that the size of the apparatus is reduced.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 15:
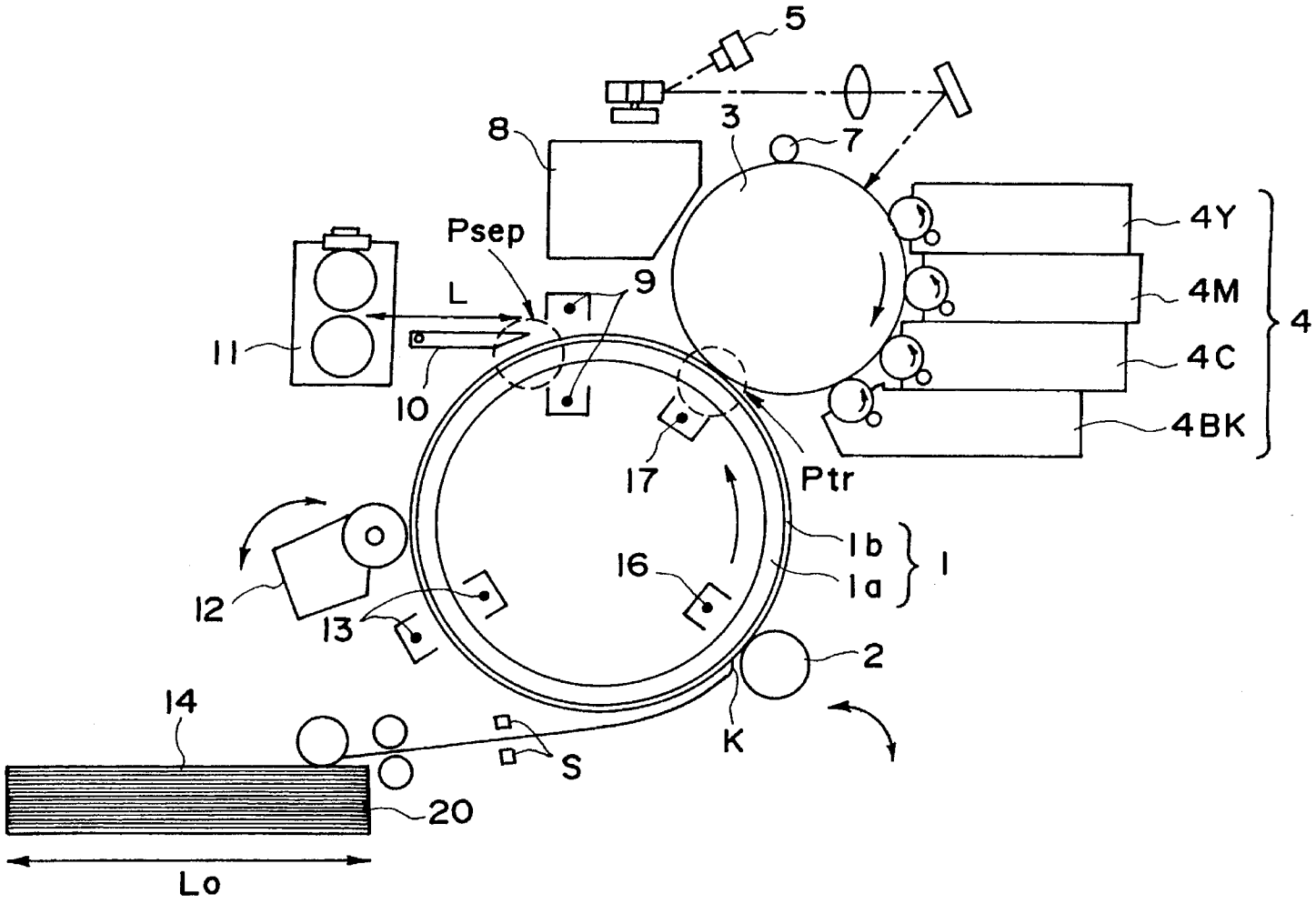
FIG. 15 is a schematic sectional view of an entire structure of an example of a color image forming apparatus of an electrophotographic type usable as the image forming apparatus of this invention.

FIG. 15 is a sectional view of a color electrophotographic printer as an exemplary image forming apparatus according to an embodiment of the present invention.

In FIG. 15, a photosensitive drum 3 functioning as an image bearing member is normally rotated in a direction indicated by an arrow in the Figure. Along the direction of rotation, there are disposed a contact type charger (charging roller) for uniformly charging the photosensitive drum 3, a developing device 4 including a plurality of developing devices 4Y, 4M, 4C and 4BK containing yellow toner (Y), magenta toner (M), cyan toner (C) and black toner (BK), respectively, a transfer drum 1 functioning as a recording material carrying member to carry a recording material (sheet) to receive the developed visual image, a cleaner 8 for removing residual toner from the photosensitive drum 3. The photosensitive drum 3, the contact type charger 7, the developing device 4 and the cleaner 8, may be contained in a process unit cartridge detachably mountable to the main assembly of the apparatus.

In this embodiment, a light signal 6 emitted by the exposure device 5 having a light source such as a laser or the like, raster-scans the photosensitive drum 3 by a rotatable mirror through an image forming lens and a reflection mirror, by which an electrostatic latent image is formed on the photosensitive drum 3. The light signal 6 is incident on an exposure position between the charger 7 and the developing device 4Y.

In the developing device 4, the developer, that is, the toner is transferred electrostatically to the electrostatic latent image formed on the photosensitive drum 3 by the light signal 6 by a selected developing device 4Y, 4M, 4C or 4BK, so that the electrostatic latent image is developed into a visualized (toner) image having the selected color. The visualized image is transferred onto a recording material 14 carried on the transfer drum at the image transfer position (image transfer station) Ptr.

Figure 16A:
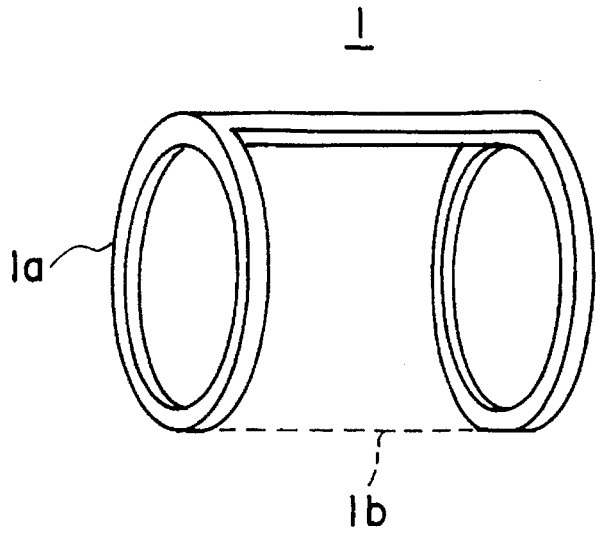
FIGS. 16A and 16B are schematic perspective views of an example of a transfer drum usable with a color image forming apparatus.

The photosensitive drum 1 is supported for rotation in the direction indicated by an arrow and is opposed to the surface of the photosensitive drum 3 without space (contact) or with small space (100 microns gap, for example). A shown in FIG. 16A, the transfer drum 1 comprises a base drum member 1*a* which is in the form of a partly-cut-away hollow cylindrical member, and a flexible sheet 1*b* covering the cut-away portion of the drum into a cylindrical form. The flexible sheet 1*b* is of polyethylene terephthalate (PET), polyvinylidene fluoride (PVdF), fluorinated ethylene propylene copolymer (FEP), polycarbonate, polyurethane or the like.

Inside or outside the transfer drum 1, there are provided, along the direction of rotation, an attraction roller 2 for electrostatically attracting onto a flexible sheet 1*b* the recording material 14 fed from the feeding cassette 20, an attraction charger 16 for charging the flexible sheet 1*b* in faced relation with the fixing roller 2, a transfer charger 17 for transferring the visualized image from the photosensitive drum 3, separation chargers 9 for separating the recording material 14 electrostatically attracted on the flexible sheet 1*b*, separation claws 10 for assisting the separation and guiding the separated recording material 14 to the fixing device 11, a transfer drum cleaner 12 for removing the toner from the surface of the flexible sheet 1*b* after the recording material separating position, and a pair of opposed discharger 13 for removing electric charge from the flexible sheet 1*b* to initialize it.

An image forming process of the color image forming apparatus having the above-described structure, will be described. First, the photosensitive drum 3 is uniformly charged by the charging roller 7, and thereafter, an electrostatic latent image of a first color is formed on the photosensitive drum 3 by the light signal 6 modulated in accordance with image signal for the first color form the exposure device 5. The first color electrostatic latent image is visualized by being developed by the developing device 4Y containing the yellow (Y) developer, for example. In parallel with the above-operation, the supplied recording material 14 is nipped between the attraction roller 2 and the transfer drum 1 by the attraction roller 2 which is movable toward and away from the transfer drum 1, and simultaneously therewith, the electric charge is applied by the attraction chargers 16 to the flexible sheet 1*b* constituting the surface of the transfer drum. In this manner, the recording material holding process of electrostatic attraction for the recording material 14 onto the surface of the transfer drum, is carried out. A reference character K in FIG. 15 designates a point on the transfer drum 1 where the leading edge of the transfer material is carried.

As for the recording material carrying means (transfer drum 1) for carrying the recording material 14, a mechanical holding means is usable which mechanically holds the leading edge of the recording material 14 by a gripper or the like, in place of the electrostatic attraction means. In this case, the leading edge of the supplied recording material 14 is gripped by the gripper (not shown), for example, and the recording material 14 is wrapped around the surface of the transfer drum 1 by the rotation of the transfer drum 1. At this time, the recording sheet 14 is sandwiched between the attraction roller 2 and the flexible sheet 1*b* constituting the transfer drum surface. Simultaneously, it is retained on the surface of the transfer drum by the electrostatic attraction force provided by the electric charge applied to the backside of the flexible sheet 1*b* by the attraction charger 16.

The recording material 14 supported on the transfer drum 1 is conveyed to an image transfer position Ptr faced to the photosensitive drum 3, by the rotation of the transfer drum 1. Then, the yellow visualized image formed on the photosensitive drum 3 is transferred onto the recording material 14 by the operation of the transfer charger 17. Thereafter, the developer remaining on the surface of the photosensitive drum 3 is removed by the cleaner. Then, the photosensitive drum 3 is uniformly charged by the charger 7, again, and an electrostatic latent image formed in accordance with a second color image signal from the exposure device 5 on the photosensitive drum 3. The second color electrostatic latent image is developed by a developing device 4M containing a magenta (M) developer, for example, corresponding to the second image signal, into a visualized magenta image. The second visualized image is transferred onto the recording material 14 still carried on the transfer drum by the transfer charger 17, again. As a result, the second visualized magenta image is overlaid on the first color yellow visualized image already transferred thereonto.

The charging, image exposure, development and transfer processes described above are repeated for the third color (cyan (C)) and fourth color (black (BK)). Thus, four color visualized images are transferred and overlaid on the recording material 14 carried on the transfer drum 1, and then, the separation chargers 9 disposed faced to the inside and outside surfaces of the transfer drum 1, are operated to remove the electrostatic attraction force between the flexible sheet 1*b* of the transfer drum and the recording material 14 carried on the transfer drum 1. In the case that the leading edge of the recording material is gripped by a gripper, the gripper is released. Simultaneously, the separation claws 10 are operated to separate the recording material 14 from the transfer drum 1 to permit the recording material to be fed to the fixing device 11, in which the overlaid visualized images are fixed on the recording material by the heat in the fixing device 11, into a permanent image. In this manner, a desired full-color print is provided. After the separation of the recording material, the transfer drum 1 is subjected to the cleaning operation in which the toner is removed from the surface of the flexible sheet 1*b* by the transfer drum cleaner 12, and subsequently, the sheet discharger 13 is operated to electrically discharge or initialize the flexible sheet 1*b*, so that it is prepared for the next transfer process.

Figure 16B:
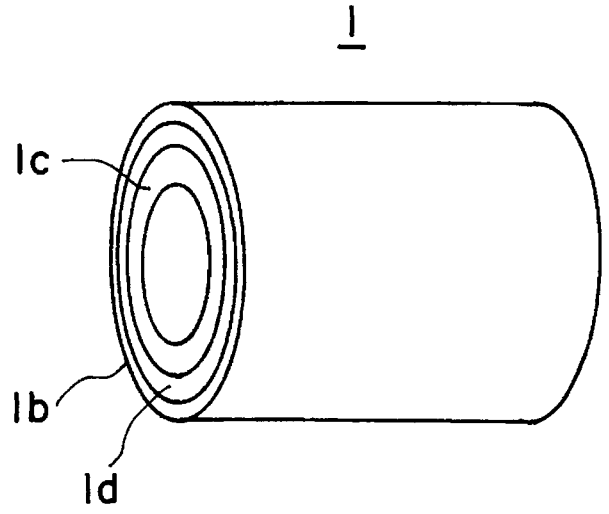

In the foregoing, the description has been made with respect to the case in which the recording material carrying member is in the form of a transfer drum 1 using a cut-away drum 1*a* (cut-away drum) as a typical recording material carrying member. However, as shown in FIG. 16, use can be made with a transfer drum 1 comprising a drum 1*c* without the cut-away portion (solid drum), an elastic material 1*d* of foamed urethane material, foamed silicone rubber material or the like which covers the drum 1*c*, and a flexible sheet 1*b* covering the surface of the elastic material 1*d*, if a proper bias voltage is applied to the transfer drum 1. With the use of such a transfer drum, the superimposing transfer can be accomplished similarly to the case of the cut-away transfer drum 1*a*.

The solid drum is advantageous in that the inside structure can be simplified as compared with the cut-away drum 1, in that the cost can be reduced correspondingly and in that the flexible sheet 1*b* is supported at the inside, and therefore, the deformation or the damage of the flexible sheet 1*b* which is a problem of the cut-away transfer drum 1, can be reduced. Therefore, a color image forming apparatus using the solid transfer drum is recently noted. The image forming process in the color image forming apparatus using the solid type transfer drum, is similar to that of the color image forming apparatus using the cut-away transfer drum.

Figure 1:
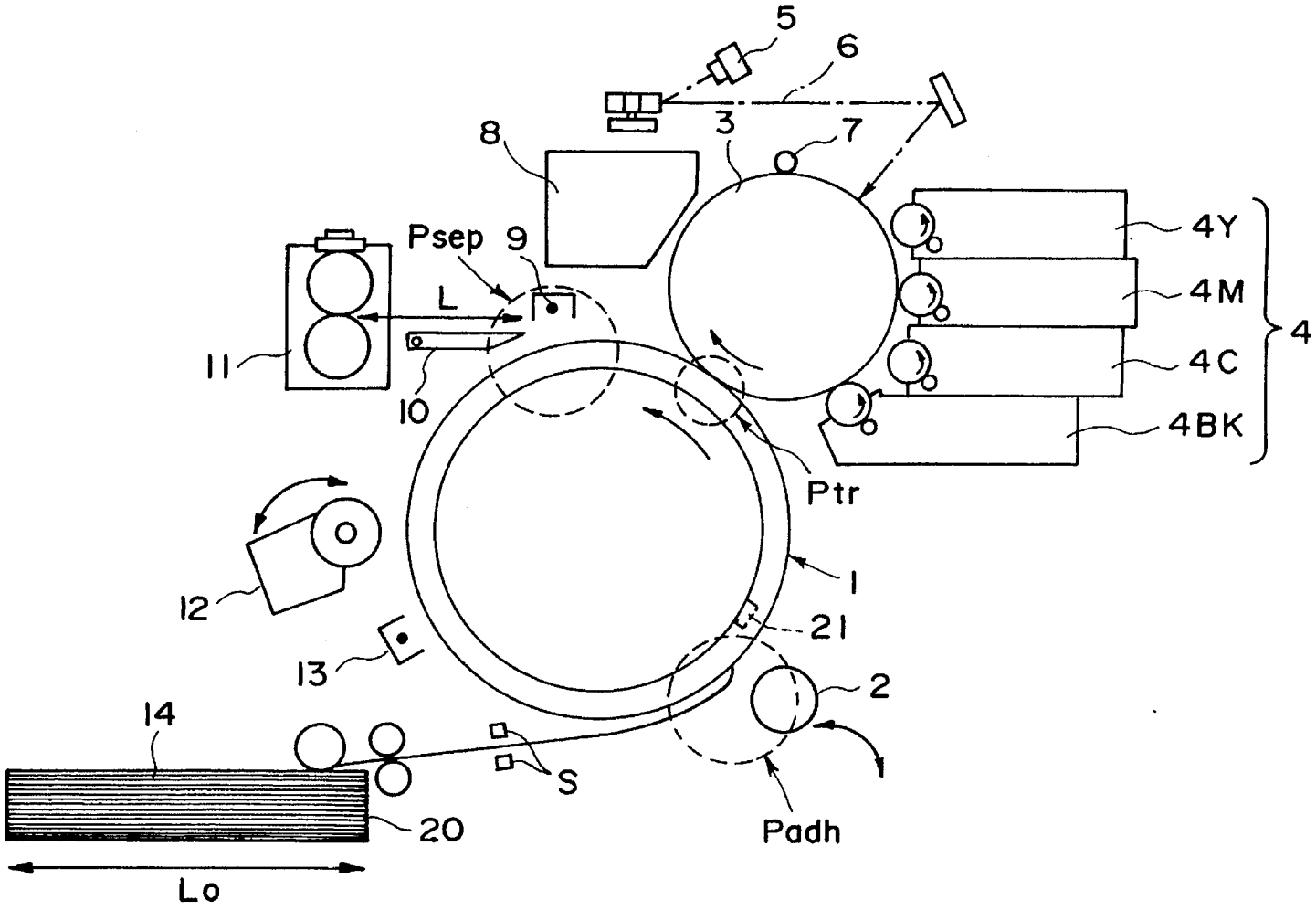
FIG. 1 is a schematic sectional view of an entire structure of a color image forming apparatus of an electrophotographic type according to a first embodiment of the present invention.

Referring to FIG. 1, the description will be made as to the image forming process of a color image forming apparatus using the solid transfer drum. The same reference numeral as in FIG. 15 are assigned to the parts, members and elements or the like having the corresponding functions, and the description thereof are omitted for simplicity.

The recording material 14 supplied to the transfer drum 1 of the solid drum type from the sheet feeding cassette 20, is nipped between the transfer drum 1 and the attraction roller 2 by the attraction roller 2 movable toward and away from the transfer drum 1. When a mechanical recording material holding means such as gripper is used, the leading edge of the recording material is gripped by a gripper for example. Simultaneously therewith, an attraction voltage and a transfer bias voltage are applied to the solid drum 1*c* and the attraction roller 2, and the recording material 14 is electrostatically supported on the transfer drum 1 by the electric charge induced thereby.

The recording material 14 carried on the solid transfer drum 1 is fed to an image transfer position Ptr faced to the photosensitive drum 3 by rotation of this transfer drum 1. Then, the yellow visualized image (first color) formed on the photosensitive drum 3 is transferred onto the recording material by the transfer charger 17. When the second color visualized image (magenta) is to be transferred, the above-described transfer bias voltage is changed to compensate for the potential having lowered by the first color image transfer on the recording material 14. Such a transfer voltage correction is carried out similarly for the third, fourth visualized image transfer operations (cyan and black colors). Thus, the four visualized images formed on the photosensitive drum 3 are sequentially transferred and overlaid on the recording material 14 carried on the transfer drum 1.

After the completion of the transfer process, the recording material 14 is electrically discharged by the separation charger 9, so that the electrostatic force relative to the transfer drum 1 is removed. In the case of a gripper used to grip the leading edge of the recording material, the gripper is released. The recording material 14 is separated from the transfer drum 1 by the separation claws 10, and is fed to the recording material carrying means 15, which in turn feed the recording material 14 to the fixing device 11. The visualized and overlaid images are fixed on the recording material 14 by the fixing device 11 into a permanent image. In this manner, a desired full-color print is provided. The transfer drum 1 after the separation of the recording material is cleaned, that is, the toner deposited on the flexible sheet 1*b* surface is removed by the operation of the transfer drum cleaner 12, and subsequently, it is electrically discharged by the operation of the sheet discharging charger 13, and therefore, it is electrically initialized, so that it is prepared for the next image transfer process.

In the foregoing, the description has been made as to the image transfer process in a color image forming apparatus using a transfer drum 1 of a solid drum type. The developing process is the same as with the developing process in the color image forming apparatus using the cut-away type transfer drum, and therefore, the description thereof is omitted for simplicity.

When the use is made with a recording material of non-plain-paper sheet such as OHT resin sheet, the recording material feeding speed by the fixing device is made lower than that when the use is made with a plain sheet of paper.

In addition, there is provided a rotation control means (not shown) for changing the speed of the transfer drum 1. When the non-plain-paper sheet is used, the non-plain-paper sheet is not immediately separated from the transfer drum after the image transfer operation of the final visualized image, but the non-plain-paper sheet feeding speed to the fixing device is lowered, while the rotational speed of the transfer drum is being reduced with the non-plain-paper sheet carried thereon. Because of this method, there is no need of using recording material feeding portion between the separation position Psep and the fixing position, and therefore, the size of the apparatus can be reduced.

Figure 14:
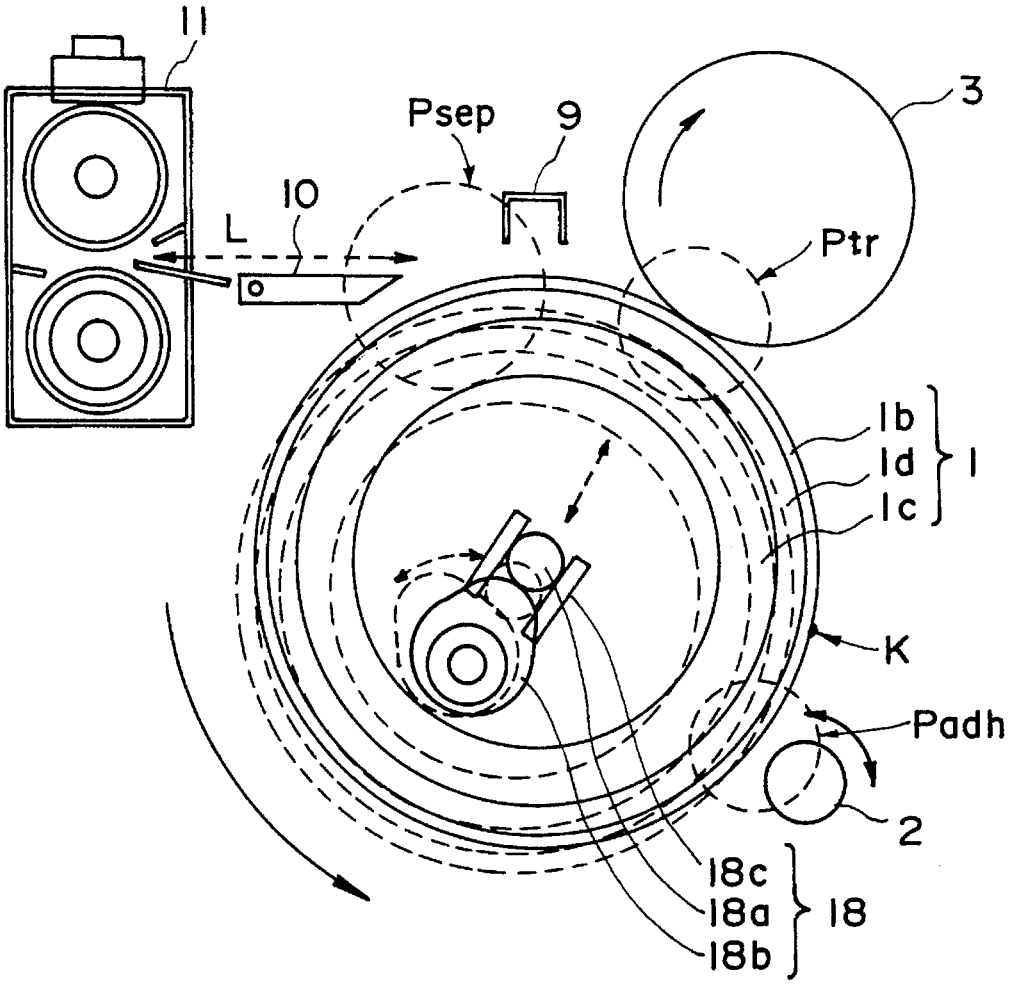
FIG. 14 is a sectional view of a spacing mechanism for providing a space between a photosensitive drum and a transfer drum.

However, when this method is used, the transfer drum 1 is disposed relative to the transfer drum 1 with a small gap (approx. 100 microns) or with a proper nip pressure, and therefore, there is a liability that the overlaid visualized images on the non-plain-paper sheet are contacted to the photosensitive drum 3 during the speed reducing process of the transfer drum. Therefore, as shown in FIG. 14, a transfer drum switching means (or moving means) 18 is provided inside the transfer drum 1, so that the transfer drum 1 carrying the non-plain-paper sheet and the photosensitive drum 3 are switched or moved to a separated position only during the transfer drum speed reducing process after the final image transfer operation. The transfer drum switching/moving means 18 of this embodiment has such a structure that a transfer drum supporting shaft 18*a* for transferring the transfer drum 1 is moved along a shaft guide 18*c* for supporting the transfer drum shaft 18*a*. However, another known separating method is usable if the transfer drum 1 and the photosensitive drum 3 are moved toward and away from each other while they are rotating. In the color image forming apparatus using the transfer drum separating means 18 shown in FIG. 14, as contrasted to the conventional color image forming apparatus, a distance L from the recording material separating position Psep to the entrance of the fixing device is shorter than a length L0 of the non-plain-paper sheet having the maximum length usable with the color image forming apparatus.

In this embodiment, the transfer drum 1 is provided with a photosensitive drum escape 21 not contacting the image forming region of the photosensitive drum 3. When the transfer drum 1 having been separated by the transfer drum separating means 18 (FIG. 14) to separate the non-plain-paper sheet, returns to the regular position for the image formation, the photosensitive drum escape 21 is faced to the photosensitive drum 1, thus preventing the deterioration of the transfer drum 1 and/or the photosensitive drum 3 due to the impact upon the contact.

Figure 2:
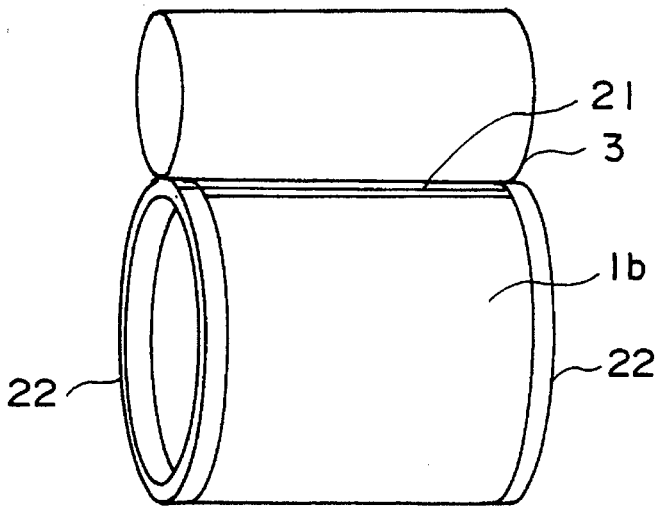
FIG. 2 is a schematic perspective view of enlarged transfer drum and photosensitive drum used in the color image forming apparatus of FIG. 1.

Referring to FIG. 2, the transfer drum 1 of this embodiment will be described in detail.

As shown in the Figure, the photosensitive drum 1 is provided with the photosensitive drum escape 21 which is in the form of a recess on the transfer drum surface at a position not carrying the recording material. At the opposite longitudinal ends of the transfer drum 1, there are provided a ring-like distance limiting members 22 for limiting the distance between the transfer drum 1 and the photosensitive drum 3. The peripheral surface of the distance limiting member 22 is substantially flush with the peripheral surface of the flexible sheet **1*b* constituting the transfer drum surface for supporting the recording material 14 in the portion other than the photosensitive drum escape 21**.

Figure 6:
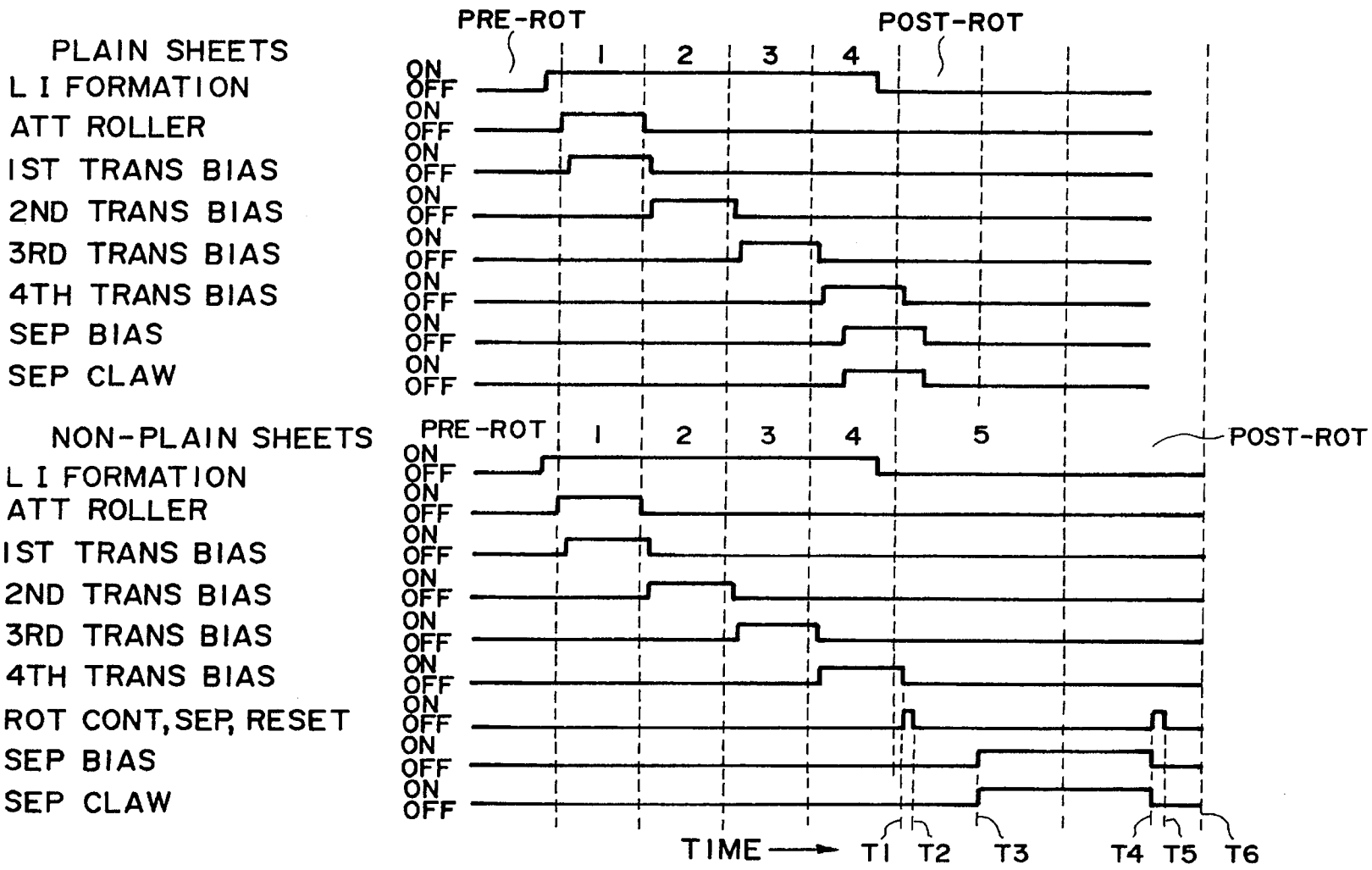
FIG. 6 is a timing chart showing sequential image forming operation on a non-plain-paper sheet as compared with a sequential image forming operation on a plain sheet in the color image forming apparatus of FIG. 1.

FIG. 6 is a timing chart of the sequential image forming operation for the non-plain-paper sheet in the color image forming apparatus provided with the transfer drum separating means 18, as compared with the sequential image forming operation for a normal recording material. In this Figure, the broken line indicating the number of rotations of the transfer drum 1 represents the time at which the point K on the transfer drum where the leading edge of the recording material is thereon is faced to the attraction roller 2.

Referring to FIG. 6, the image forming sequential operation for the non-plain-paper sheet will be described.

The recording material 14 supplied from the sheet feeding cassette 20 is sensed by a sensor S which is discriminating means for discriminating the material of the recording material optically or mechanically in the feeding path to the transfer drum 1, and the discrimination is made as to whether or not the recording material 14 is a non-plain-paper recording material or not. If the result of discrimination is that the recording material 14 is a plain sheet of paper, the image forming operations for the plain paper is carried out. However, if the result of the discrimination shows that the recording sheet 14 is non-plain-paper sheet, the following image forming process is carried out.

The recording sheet is fed to the transfer drum 1 after being detected by the sensor S, and is carried on the transfer drum 1. During a first rotation thereof, the first color visualized image is transferred. Subsequently, during the second and third rotations, different color visualized images are sequentially transferred and overlaid. Thereafter, the final color visualized image is transferred during the fourth rotation. However, even if all of the four color visualized images are transferred to the non-plain-paper sheet, the non-plain-paper sheet is not separated from the transfer drum 1, as contrasted to the case of the plain paper.

At the time T1 at which all of the four visualized images are transferred onto the non-plain-paper sheet, the transfer drum 1 carrying the sheet is separated from the photosensitive drum 3 by the actuation of the transfer drum separating means 18 (FIG. 14) to a distance at which the visualized images on the non-plain-paper sheet are not disturbed by the photosensitive drum 3. Subsequently, the rotational speed of the separated transfer drum 1 is reduced, during the period from T1 to T2, from the normal image forming speed V1 down to a speed substantially equal to the non-plain-paper sheet fixing speed V2 at which the images are properly fixed on the non-plain-paper sheet, by the rotation control means (not shown). From the time T3 after the completion of the speed reducing process, the non-plain-paper sheet is separated from the recording material separating position Psep, and thereafter, it is directly fed to the fixing device 11.

During a period between T4 at which the trailing edge of the sheet is separated at the recording material separating position Psep and the time T5, the speed of the transfer drum 1 is increased by the rotation control means to a transfer drum restoring speed V3 from the fixing speed V2. The transfer drum now rotating at the restoring speed V3 is returned to the regular transfer drum position (that is, the position for properly transferring the visualized images from the photosensitive drum 3) at the time T5, by the transfer drum separating means 18.

In the transfer drum returning process, the photosensitive drum 3 and the transfer drum i are contacted with each other in the image transfer position Ptr at the time T5, and at this time, the portion of the transfer drum faced to the photosensitive drum 3 is the above-described photosensitive drum escape 21.

Therefore, only the distance limiting members 22 at the opposite ends of the transfer drum 1 are contacted to the photosensitive drum 3 at the time T5. In addition, the distance limiting member 22 is contacted to the non-image forming region of the photosensitive drum 3.

For this reason, the impact upon the restoration of the transfer drum is not imparted to the image forming region of the photosensitive drum 3, and therefore, the deterioration of the photosensitive drum 3 which has been described hereinbefore, does not result. Since the recording material carrying surface of the photosensitive drum 1 is not contacted to the photosensitive drum 3 at the time T5, the deterioration of the transfer drum surface is also prevented.

Figure 3:
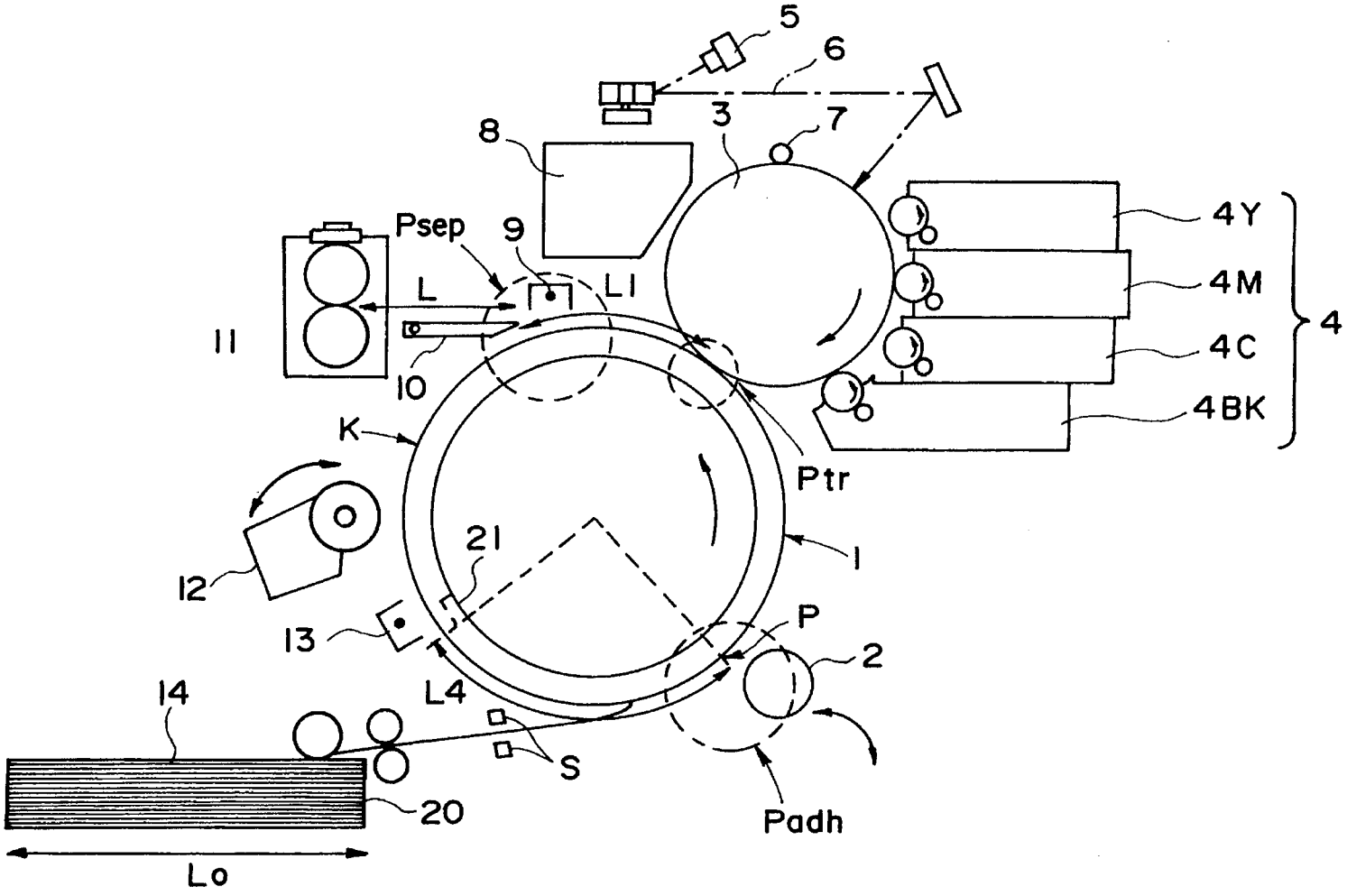
FIG. 3 is a schematic sectional view of a color image forming apparatus to illustrate conditions for minimizing a transfer drum restoration time in the color image forming apparatus of FIG. 1.

Referring to FIG. 3, when the above-described method is used, the time period required for the restoration of the transfer drum 1 is minimized if a distance L4 measured along the surface of the transfer drum along the rotational direction of the transfer drum from a point P on the transfer drum 1 at which the trailing edge of the non-plain-paper sheet is carried to the escape 21, and a distance L1 measured along the surface of the transfer drum in the direction of the rotation of the transfer drum from the image transfer position Ptr to the recording material separating position Psep, satisfy the following:

$$L1<L4 \quad (1)$$

If this is satisfied, the escape 21 of the transfer drum 1 is disposed upstream of the image transfer position Ptr in the rotational direction of the transfer drum when the separation of the sheet is completed at the recording material separating position Psep. Therefore, the transfer drum returning process can be immediately started. This eliminates the necessity for the idle rotation of the photosensitive drum 1 for the purpose of aligning the escape 21 of the transfer drum 1 to the image transfer position Ptr again during the transfer drum returning process. Therefore, the time period required for the transfer drum restoration process can be reduced.

In this embodiment, the distance limiting member 22 is provided at each longitudinal end of the transfer drum 1. When, for example, the photosensitive drum 3 is directly driven by the transfer drum 1, the distance may be limited by engagement of the driving gears of the transfer drum 1 and the photosensitive drum 3. In this case, the distance limiting member 22 for the transfer drum 1 is provided only at one side.

The distance limiting member 22 is not limited to the structure described above if the depth of interference between the transfer drum 1 and the photosensitive drum 3 and the contact pressure are controlled. Therefore, known various means are usable.

Figure 4:
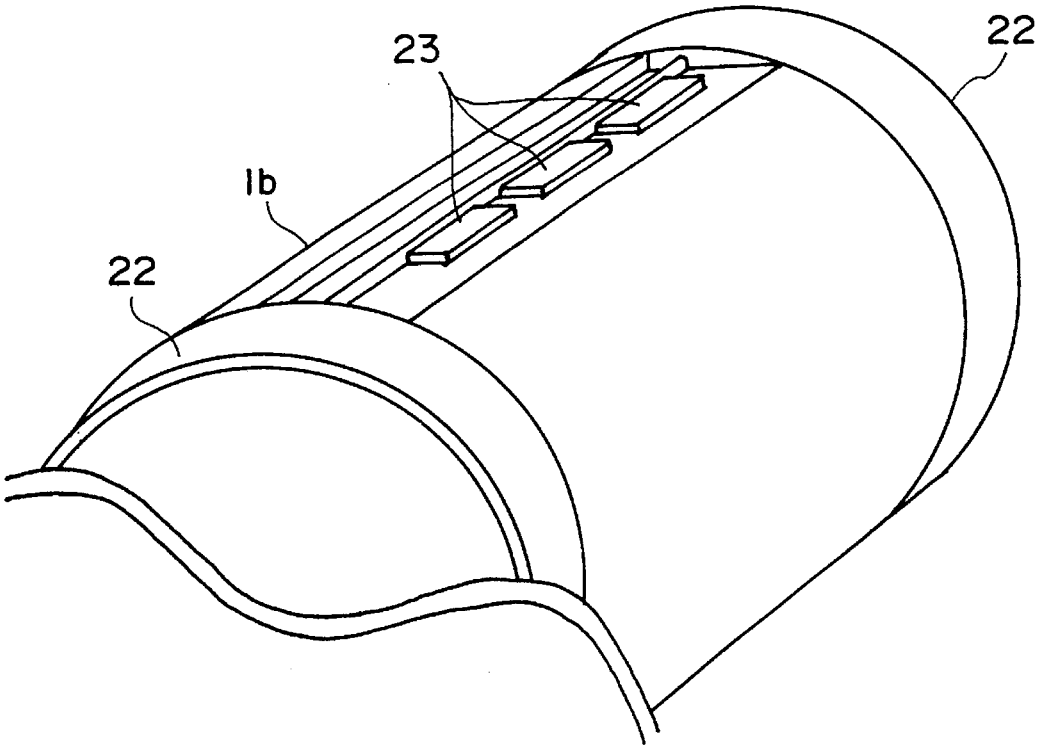
FIG. 4 is a schematic perspective view of a major portion of a transfer drum of a different structure, usable with the color image forming apparatus of FIG. 1.

In the foregoing embodiment, the recording material carrying means for carrying the recording material is in the form of electrostatic attraction means. This may be mechanical means such as gripper 23 for gripping a leading end portion of the recording material, as shown in FIG. 4. When the gripper 23 is used for the recording material holding means, the gripper 23 is disposed in a recessed portion of the photosensitive drum 1 surface such as the escape 21 in the foregoing embodiment so that it is prevented from contacting the photosensitive drum 3. Therefore, when mechanical holding means such as a gripper 23 is used as the recording material holding means, a photosensitive escape 21 is not necessarily formed on the transfer drum 1 if the portion having the mechanical holding means (gripper 23 in this embodiment) is used as the escape 21. By doing so, the structure may be simplified.

Figure 5:
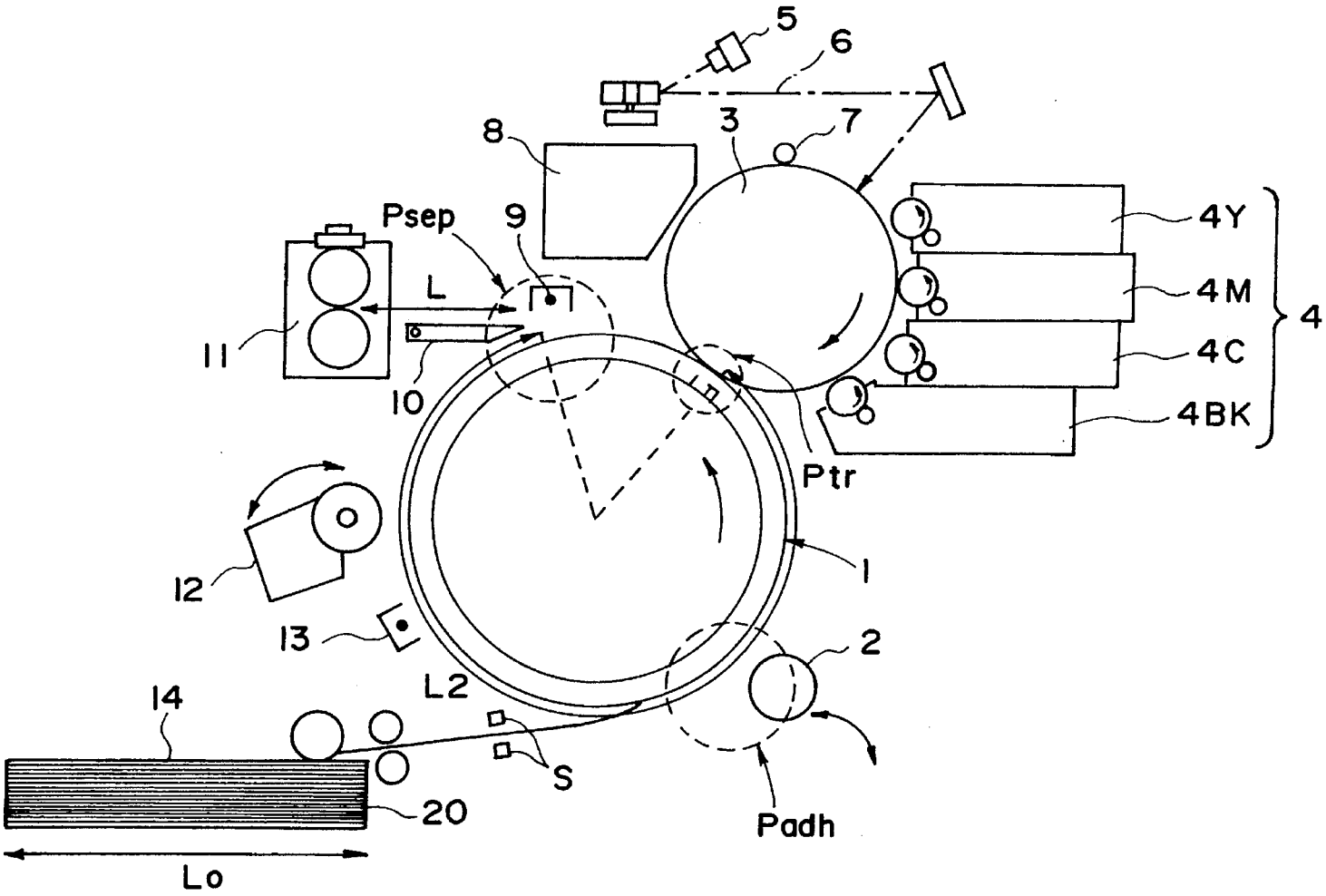
FIG. 5 is a schematic sectional view of a color image forming apparatus to illustrate conditions for minimizing the transfer drum restoration time when a transfer drum of FIG. 4 is used in the color image forming apparatus of FIG. 1.

In this manner, when the mechanical holding means such as gripper is used as the recording material holding means, as shown in FIG. 5, the time required for returning the transfer drum 1 is minimized, if a length L0 having a maximum length of the non-plain-paper sheet retained on the transfer drum 1, and a distance L2 measured along the surface of the transfer drum in the rotational direction of the transfer drum from the recording material separating portion Psep to the image transfer position Ptr, at least satisfy the following relationship:

$$L2>L0 \quad (2)$$

When this is satisfied, the portion of the gripper 23 on the transfer drum 1 is disposed upstream of the image transfer position Ptr in the rotational direction of the transfer drum upon the completion of the separation of the non-plain-paper sheet at the recording material separating position Pest. Therefore, the transfer drum returning process can be started immediately after the separation of the sheet. Accordingly, it is not necessary to rotate idly the transfer drum 1, during the transfer drum 1 restoration process, for the purpose of aligning the position of the gripper 23 on the transfer drum 1 with the image transfer position Ptr, again. Therefore, the time required for the transfer drum restoration can be reduced.

In the foregoing, the description has been made with respect to the case in which the solid type transfer drum is used, but the embodiment is usable with the cut-away type transfer drum with the same advantageous effects.

Referring to FIGS. 7–10, a second embodiment of the present invention will be described.

Figure 7:
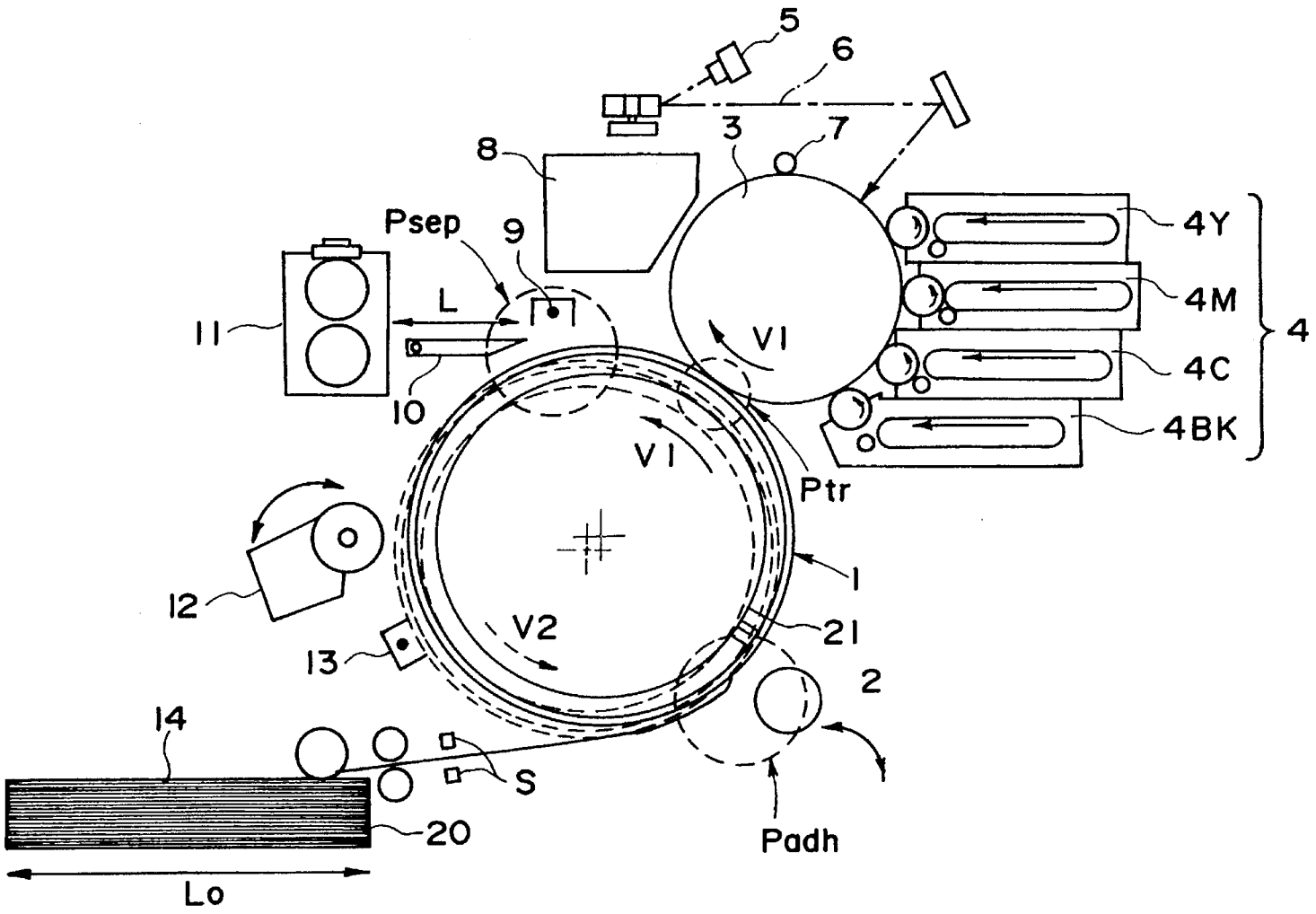
FIG. 7 is a schematic sectional view illustrating an entire structure of a color image forming apparatus of an electrophotographic type according to a second embodiment of the present invention.

FIG. 7 shows a general arrangement of an electrophotographic type color image forming apparatus having a mechanical recording material holding means such as a gripper on a recording material carrying means. The structure of the color image forming apparatus of this embodiment is the same as in FIG. 1 embodiment except for the mechanical recording material holding means, and therefore, the detailed descriptions are omitted by assigning the same reference numerals as in FIG. 1 to the members, parts, elements or the like, and the detailed description thereof are omitted.

Similarly to the foregoing embodiment, the color image forming apparatus of this embodiment carried out the charging, exposure, developing and transfer processes, sequentially. By doing so, a plurality of visualized images (toner images) having different colors are sequentially formed on the photosensitive drum 3 by a plurality of developing devices 4Y, 4M, 4C and 4BK containing different color developers (toners), respectively. The visualized images are sequentially transferred and overlaid on the same recording material carried on the transfer drum 1, and a full-color image or a multi-color image is provided through a plurality of recording cycles.

The description will be made as to a color image formation process in the image forming apparatus of this embodiment.

The recording material 14 supplied from the sheet feeding cassette 20 is sensed by a sensor S which is discriminating means for discriminating the material of the recording material optically or mechanically in the feeding path to the transfer drum 1, and the discrimination is made as to whether or not the recording material 14 is a non-plain-paper recording material or not. If the result of discrimination is that the recording material 14 is a plain sheet of paper, the image forming operations for the plain paper is carried out. However, if the result of the discrimination shows that the recording sheet 14 is non-plain-paper sheet, the following image forming process is carried out.

The recording sheet is fed to the transfer drum 1 after being detected by the sensor S, and is gripped at its leading edge by a mechanical holding means such as a gripper, and is carried on the transfer drum 1. During a first rotation thereof, the first color visualized image is transferred. Subsequently, during the second and third rotations, different color visualized images are sequentially transferred and overlaid. Thereafter, the final color visualized image is transferred during the fourth rotation. However, even if all of the four color visualized images are transferred to the non-plain-paper sheet, the non-plain-paper sheet is not separated from the transfer drum 1, as contrasted to the case of the plain paper.

At a time at which all of the four visualized images are transferred onto the non-plain-paper sheet, the transfer drum 1 carrying the sheet is separated from the photosensitive drum 3 by the actuation of the transfer drum separating means 18 (FIG. 14) to a distance at which the visualized images on the non-plain-paper sheet are not disturbed by the photosensitive drum 3. Subsequently, the rotational speed of the separated transfer drum 1 is reduced, from the normal image forming speed V1 down to a speed substantially equal to the non-plain-paper sheet fixing speed V2 at which the images are properly fixed on the non-plain-paper sheet, by the rotation control means (not shown). After the completion of the speed reducing process, the non-plain-paper sheet is separated from the recording material separating position Psep, and thereafter, it is directly fed to the fixing device 11.

After the trailing edge of the sheet is separated at the recording material separating position Psep and the time T5, the speed of the transfer drum 1 is increased by the rotation control means to a transfer drum restoring speed V3 from the fixing speed V2. At this time, the rotational speed of the photosensitive drum 3 is adjusted to be the transfer drum returning speed V2 which is the transfer drum rotating speed.

The transfer drum now rotating at the restoring speed V3 is returned to the regular transfer drum position (that is, the position for properly transferring the visualized images from the photosensitive drum 3) by the transfer drum separating means 18.

In this case, the transfer drum returning speed V3 which is the rotational speed of the transfer drum 1 and the photosensitive drum 3 may be V3=0 which is easiest to control. However, when the image forming operation is carried out continuously, it is required to increase the rotational speed to the image formation speed V1 again upon the next image forming process, and therefore, it is preferable that the transfer drum returning or restoration speed V3 is equal to the image forming speed V1. By doing so, the photosensitive drum 3 may continue to rotate at the image forming speed V1 from the restoration to the next image formation, and therefore, there is no need of control of the rotation.

Thus, according to this embodiment, the speed difference δV is removed between the rotational speed of the transfer drum and that of the photosensitive drum 3, and therefore upon the contact between the transfer drum 1 and the photosensitive drum 3, the peripheral speed difference δV is substantially 0. Thus, the impact upon the contact between the transfer drum 1 and the photosensitive drum 3, can be reduced. The deteriorations of the photosensitive drum 3 and the transfer drum 1 by the impact upon the contact which arises from the structure of the photosensitive drum 3 and the transfer drum 1 separable from each other, can be prevented.

As for the rotation control means for the photosensitive drum 3, the transfer drum 1 and the fixing device 11, there are known methods, such as the mechanical reduction using driving gear switcheable by clutch or the like widely known as rotational speed changing means, or the rotational speed of the driving motor is changed to reduce the speed. Among them, the method in which a pulse motor is used as a driving motor, and the frequency of the pulse signal for controlling the motor is changed, is desirable since it is most simple and least expensive.

In addition to the rotation control means, there may be provided means for detecting the rotational speeds of the transfer drum and the photosensitive drum, and the sequential operation may be carried out to effect rotation control until the speed difference is removed, upon the restoration of the transfer drum. Then, the peripheral speeds of the transfer drum 1 and the photosensitive drum are synchronized. This further reduces the friction upon the contact.

Figure 8:
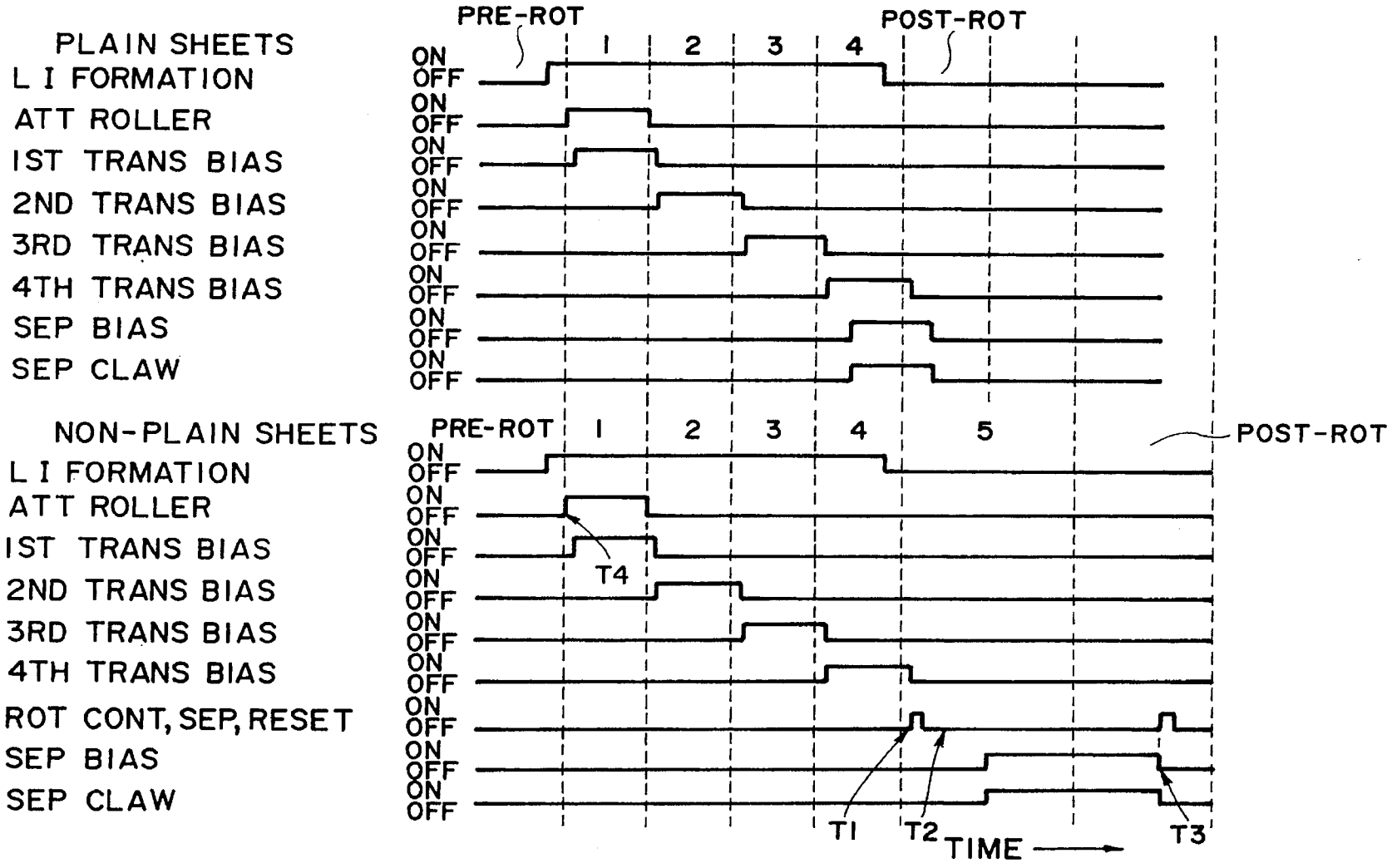
FIG. 8 is a timing chart of a sequential image forming operation on a non-plain-paper sheet as compared with a sequential image forming operation on a normal recording sheet in the color image forming apparatus of FIG. 7.

Referring to FIG. 8 timing chart, the description will be made as to the timings of separation, restoration and speed reduction of the transfer drum.

As described hereinbefore, the separation of the transfer drum may be carried out at any time between the time T1 at which the last visualized image is finished to be transferred onto the trailing edge of the non-plain-paper sheet at the image transfer position Ptr and the time T2 at which the leading edge of the sheet comes to the image transfer position. Not only the separation of the transfer drum 1 but also the rotation control of the transfer drum may be effected during the time (T1–T2). This eliminates the further rotation of the drum for the rotation control, and therefore, the image forming speed is further increased.

The returning of the transfer drum may be effected at any time after the rotational speed of the transfer drum 1 is changed and within a period between the time T3 at which the trailing edge of the non-plain-paper sheet is separated at the separating position Psep and the time T4 at which the portion holding the recording material leading edge (the portion of the mechanical recording material holding means such as gripper 23 or the like) holds the next recording material at the recording material supporting position (recording material holding portion) Padh.

Figure 9:
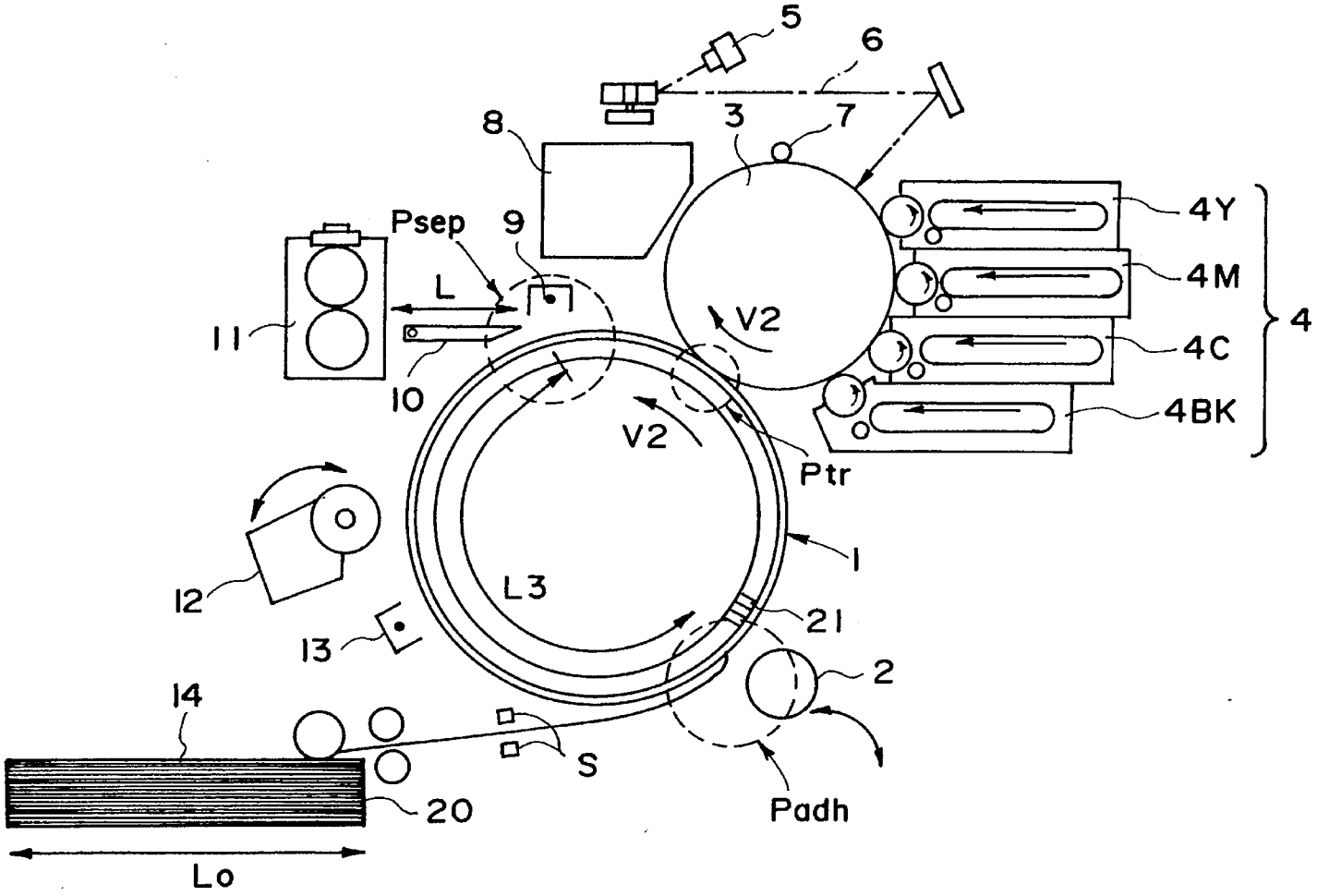
FIG. 9 is a schematic sectional view of a color image forming apparatus to illustrate conditions for minimizing the transfer drum restoration time in the color image forming apparatus of FIG. 7.

Referring to FIG. 9, in order to satisfy the above condition and the minimize the idle rotation of the transfer drum, the following conditions are satisfied:

$$L3 \geqq d1+L0 \quad (3)$$

Where L3 is a distance, measured along the peripheral surface of the drum 1 in the rotational direction thereof, between the recording material separating portion Psep having the separation claws or the like and the recording material holding portion Padh for holding the recording material on the transfer drum; d1 is the distance, on the periphery of the transfer drum, through which the surface thereof moves during the restoration and the rotation control (the distance through which the portion for holding the leading edge of the recording material on the transfer drum 1 moves during the restoration and the rotation control of the transfer drum); and L0 is the length of the usable longest non-plain-paper sheet.

In the foregoing, the description has been made as to the solid type (hard shell) transfer drum. However, the cut-away type transfer drum is usable.

Figure 10:
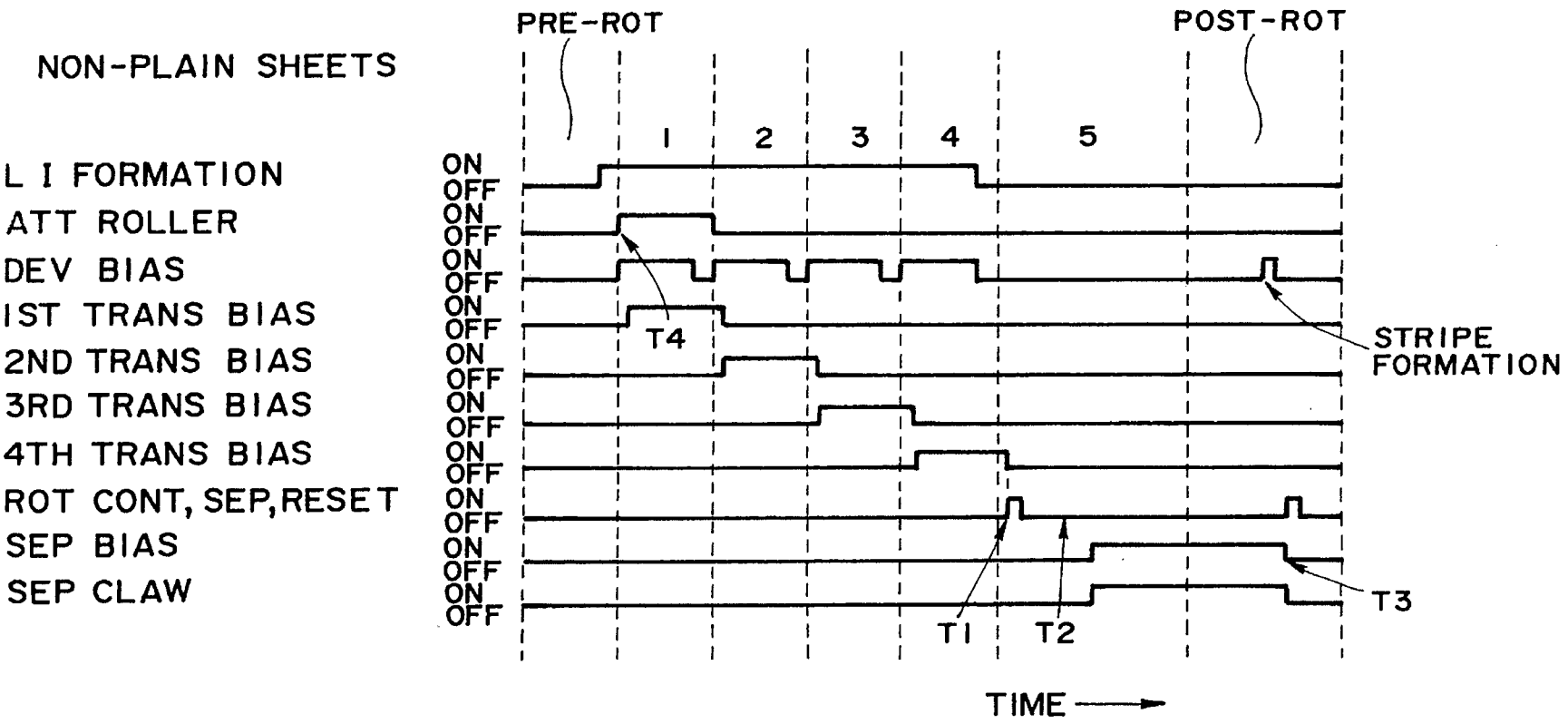
FIG. 10 is a timing chart of another example of a sequential image forming operation on the non-plain-paper sheet in the color image forming apparatus of FIG. 7.

In the foregoing embodiments, as shown in FIG. 10, a band of developer may be formed beforehand on the photosensitive drum 3 at a portion which is going to contact the transfer drum 1. By doing so, the friction upon the returning contact can be reduced. Therefore, the loads on the photosensitive drum 3 and the transfer drum 1 can be reduced, and therefore, the deterioration of the photosensitive drum 3 and the transfer drum 1 due to the separation of the transfer drum can be reduced.

The formation of the developer band may be accomplished through a known method as used when a developer band to reduce the friction between the photosensitive drum and a cleaner 8. When the developer band is formed, the developer deposited on the transfer drum upon the returning of the transfer drum 1 is removed by the transfer drum cleaner 12 disposed downstream of the image transfer position Ptr. In this case, the above relation (3) is satisfied.

Figure 11:
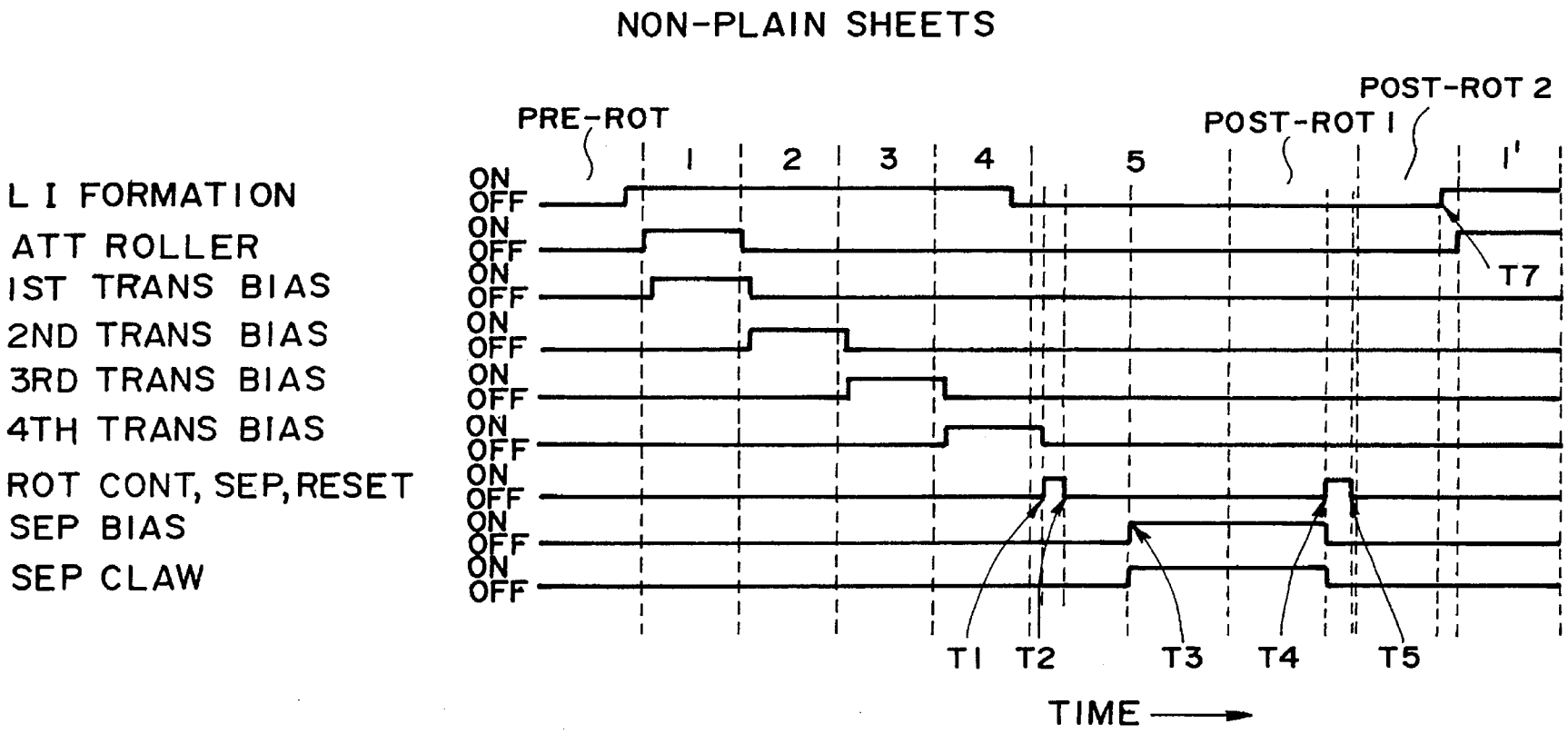
FIG. 11 is a timing chart of the image forming sequential operation on the non-plain-paper sheet by a color image forming apparatus of an electrophotographic type according to a third embodiment of the present invention.
Figure 12:
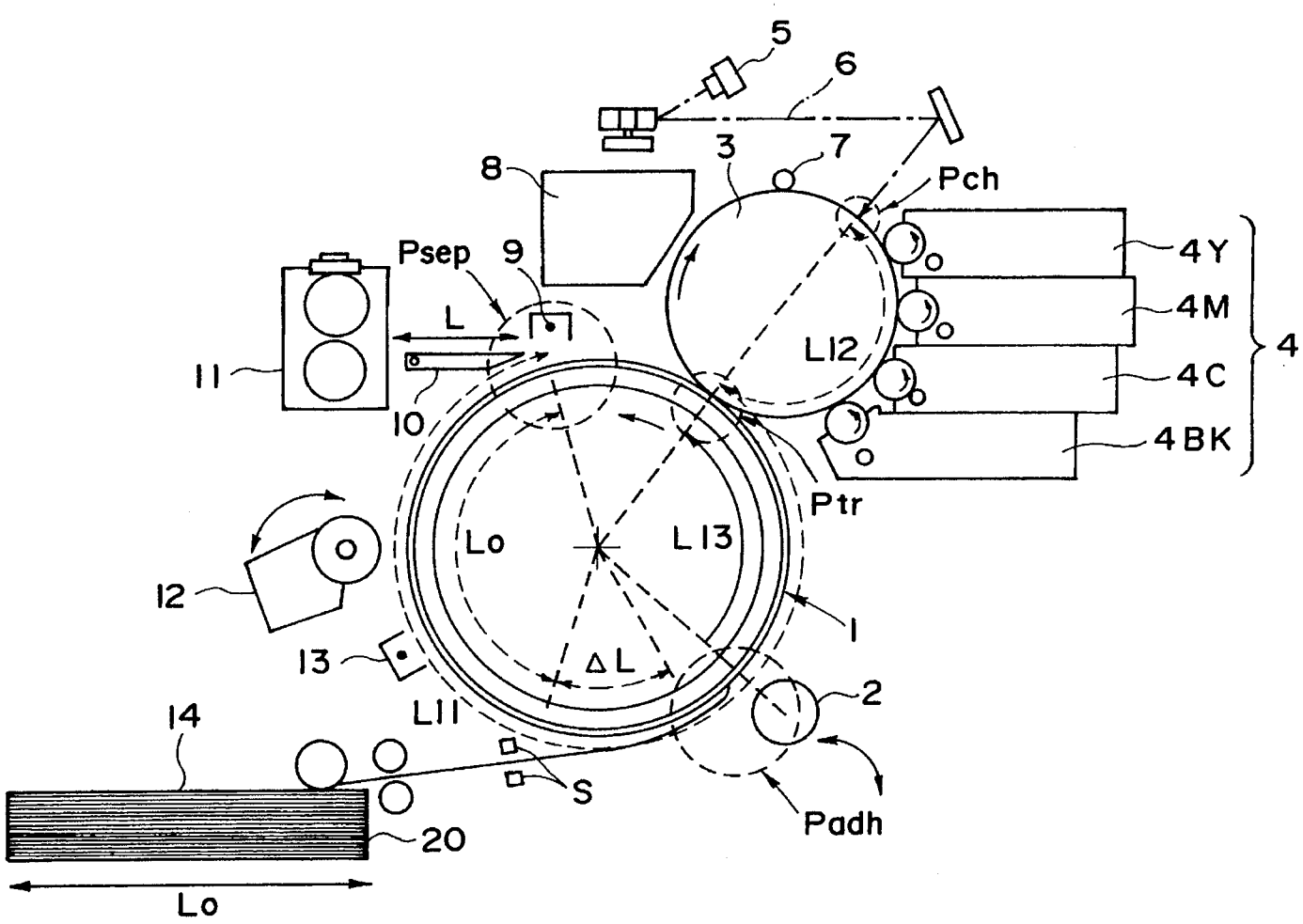
FIG. 12 is a schematic sectional view of an entire structure of a color image forming apparatus of an electrophotographic type according to a fourth embodiment of the present invention.
Figure 13:
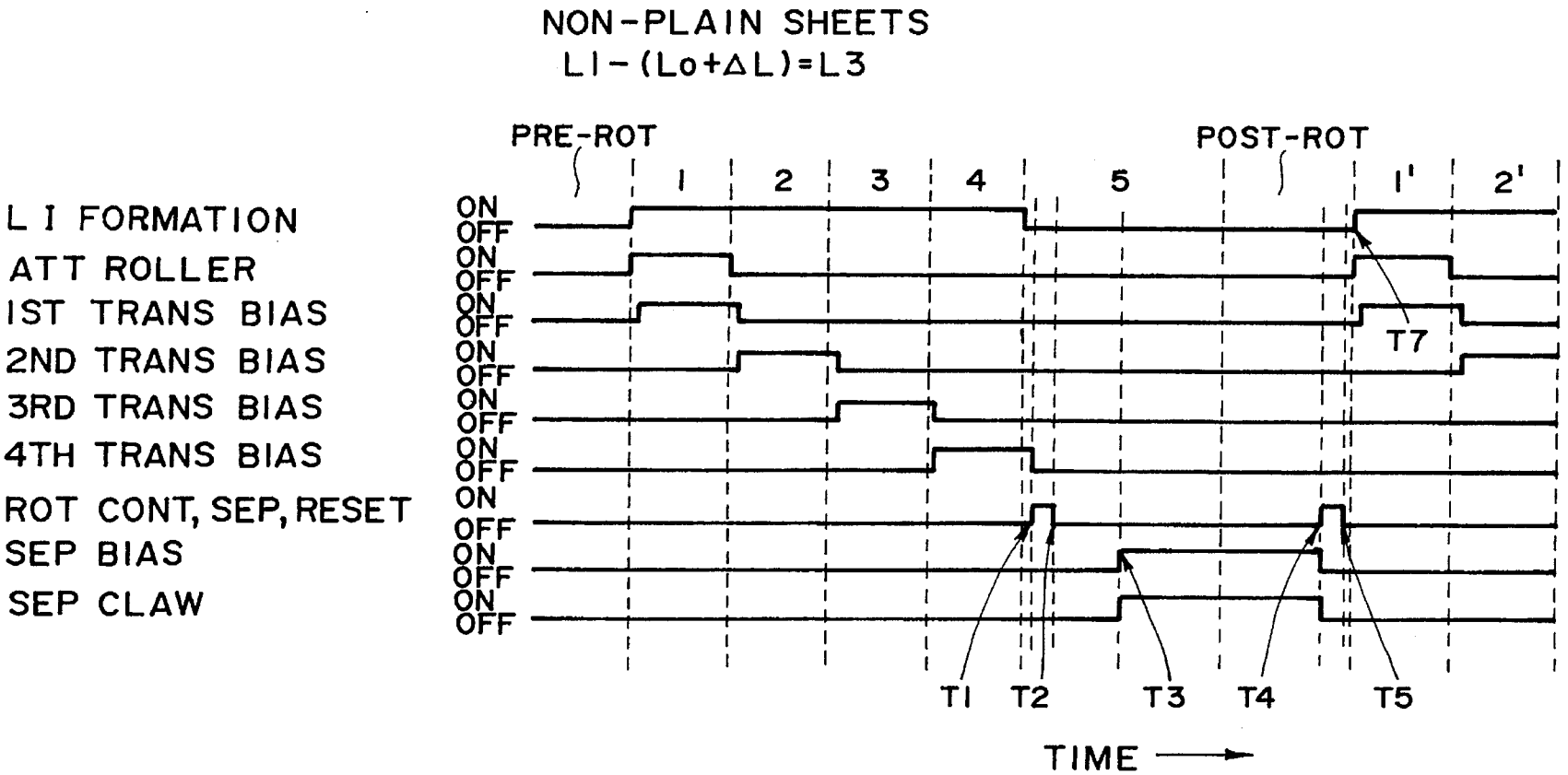
FIG. 13 is a timing chart of a sequential image forming operation on a non-plain-paper sheet in the color image forming apparatus of FIG. 12.

Referring to FIGS. 11–13, the description will be made as to a third embodiment of the present invention. The structure of the color image forming apparatus of this embodiment is the same as in FIG. 1 embodiment, and therefore, the detailed descriptions are omitted by assigning the same reference numerals as in FIG. 1 to the members, parts, elements or the like, and the detailed description thereof are omitted.

Similarly to the foregoing embodiment, the color image forming apparatus of this embodiment carried out the charging, exposure, developing and transfer processes, sequentially. By doing so, a plurality of visualized images (toner images) having different colors are sequentially formed on the photosensitive drum 3 by a plurality of developing devices 4Y, 4M, 4C and 4BK containing different color developers (toners), respectively. The visualized images are sequentially transferred and overlaid on the same recording material carried on the transfer drum 1, and a full-color image or a multi-color image is provided through a plurality of recording cycles.

The description will be made as to a color image formation process in the image forming apparatus of this embodiment.

The recording material 14 supplied from the sheet feeding cassette 20 is sensed by a sensor S which is discriminating means for discriminating the material of the recording material optically or mechanically in the feeding path to the transfer drum 1, and the discrimination is made as to whether or not the recording material 14 is a non-plain-paper recording material or not. If the result of discrimination is that the recording material 14 is a plain sheet of paper, the image forming operations for the plain paper is carried out. However, if the result of the discrimination shows that the recording sheet 14 is non-plain-paper sheet, the following image forming process is carried out.

The recording sheet is fed to the transfer drum 1 after being detected by the sensor S, and is carried on the transfer drum 1 by recording material holding means. During a first rotation thereof, the first color visualized image is transferred. Subsequently, during the second and third rotations, different color visualized images are sequentially transferred and overlaid. Thereafter, the final color visualized image is transferred during the fourth rotation. However, even if all of the four color visualized images are transferred to the non-plain-paper sheet, the non-plain-paper sheet is not separated from the transfer drum 1, as contrasted to the case of the plain paper.

At the time T1 at which all of the four visualized images are transferred onto the non-plain-paper sheet, the transfer drum 1 carrying the sheet is separated from the photosensitive drum 3 by the actuation of the transfer drum separating means 18 (FIG. 14) to a distance at which the visualized images on the non-plain-paper sheet are not disturbed by the photosensitive drum 3. Subsequently, the rotational speed of the separated transfer drum 1 is reduced, during the period from T1 to T2, from the normal image forming speed V1 down to a speed substantially equal to the non-plain-paper sheet fixing speed V2 at which the images are properly fixed on the non-plain-paper sheet, by the rotation control means (not shown). From the time T3 after the completion of the speed reducing process, the non-plain-paper sheet is separated from the recording material separating position Psep, and thereafter, it is directly fed to the fixing device 11.

During a period between T4 at which the trailing edge of the sheet is separated at the recording material separating position Psep and the time T5, the speed of the transfer drum 1 is increased by the rotation control means to a transfer drum restoring speed V3 from the fixing speed V2. The transfer drum now rotating at the restoring speed V3 is returned to the regular transfer drum position (that is, the position for properly transferring the visualized images from the photosensitive drum 3) at the time T5, by the transfer drum separating means 18.

In the transfer drum returning process, the photosensitive drum 3 and the transfer drum 1 are contacted at the image transfer position Ptr and at the time T5, but in this embodiment, the electrostatic latent image for the next image is not formed on the photosensitive drum 3. More particularly, in this embodiment, the formation of the electrostatic latent image of the next image is started at the time T7 after the restoration of the transfer drum i to the normal image forming speed V1.

Therefore, even if the contact between the transfer drum 1 and the photosensitive drum 3 at the time T5 results in small vibration in the rotation of the photosensitive drum 3 by the impact, the next latent image formation is not disturbed because no latent image formation is carried out on the photosensitive drum 3.

As described, according to this embodiment, the number of post-rotation is increased by one when the images are formed on the non-plain-paper sheet continuously. During the additional post-rotation, the latent image of the next image is formed, and therefore, even if the photosensitive drum 3 rotation is vibrated by the impact upon the restoration of the separated transfer drum 1, no latent image is formed, and therefore, the latent image formation is not disturbed by the impact, and therefore, the formed image is not significantly disturbed.

If the use is made with a transfer drum as shown in FIG. 2 used in the first embodiment (the transfer drum is provided with a photosensitive drum escape 21 in the form of a recess at a portion of the transfer drum 1 contactable to the photosensitive drum 3 at the time T5), the impact itself can be reduced upon the restoration of the transfer drum, and therefore, the deteriorations of the transfer drum and the photosensitive drum due to the impact can be prevented.

It is also possible, as in the second embodiment, that upon the restoration of the transfer drum 1 the rotational speeds of the transfer drum 1 and the photosensitive drum 3 are made equal to each other at the time T5 so as to provide substantially 0 speed difference between the drums. By doing so, the impact occurring at the contact of the transfer drum 1 and the photosensitive drum 3, can be reduced, and therefore, the deteriorations of the photosensitive drum 3 and the transfer drum 1 due to the impact upon the contact, can be prevented, and therefore, it is preferable.

If the transfer drum 1 or the photosensitive drum 3 is provided with a distance limiting member for limiting the distance between the axes of the transfer drum 1 and the photosensitive drum 3 (in the first embodiment, this is in the form of a rings 22 at the opposite longitudinal ends of the transfer drum 1), the recording material carrying surface of the transfer drum and the image forming area of the photosensitive drum surface are not directly contacted because of the distance limiting member on either of the drums upon the contact between the transfer drum 1 and the photosensitive drum 3 at the time T5 (restoration of the photosensitive drum 1). Therefore, the image forming area of the photosensitive drum 3 is free from the impact upon the restoration of the transfer drum, and therefore, the deteriorations of the photosensitive drum 3 and the transfer drum 1 can be more effectively prevented.

Referring to FIG. 12, a fourth embodiment of the present invention will be described. This embodiment is used also in an electrophotographic type color image forming apparatus shown in FIG. 1. The general arrangement thereof is the same as in FIG. 1, and therefore, the same reference numerals as in FIG. 1 are assigned to the members, parts, elements or the like having the corresponding functions, and the detailed description thereof are omitted for simplicity.

In this embodiment, the following relationships are satisfied among the maximum non-plain-paper sheet length usable with the apparatus, a distance $\delta L$ through which a given point on the peripheral surface of the transfer drum i moves in the returning period of the transfer drum (from the time T4 to the time T5), a distance L11 measured along the peripheral surface of the transfer drum from the recording material separating position Psep for separating the recording material from the transfer drum 1 to the image transfer position Ptr at which the transfer drum is opposed to the photosensitive drum 3, and a distance L12 measured along the peripheral surface of the photosensitive drum from a latent image forming position (latent image forming station) Pch on the photosensitive drum 3 to the image transfer position Ptr:

$$L11-(L0+\delta L)>L12 \quad (4)$$

The sequential image formation for the non-plain-paper sheet under the condition that equation (4) is satisfied, is shown in FIG. 13. As will be understood from FIG. 13, the latent image formation timing T7 in this embodiment is later than the timing T5 at which the transfer drum returns. When the above inequation (4) is satisfied, the latent image is formed after the transfer drum 1 returns from the separated position to the original position (after the recording material is held) in any case. Therefore, the electrostatic latent image is always formed after the transfer drum 1 returns to the regular image forming station (that is, the visualized image can be properly transferred from the photosensitive drum 3). Therefore, when the images are continuously formed on the non-plain-paper sheet, the next electrostatic latent image is always formed after the transfer drum 1 returns to the regular transfer drum position for the image formation. Therefore, the disturbance of the electrostatic latent image formation described above does not occur.

According to this embodiment, there is no need of increasing the number of post-rotations as in the third embodiment, and therefore, the printing period required for continuous image formation on the non-plain paper sheet, can be reduced as compared with the third embodiment.

Further preferably, when the left side in the inequation (4) satisfies the following relationship, the diameter of the transfer drum in this embodiment can be minimized, and therefore, the apparatus size can be further reduced.

$$L11-(L0+\delta L)=L13 \quad (5)$$

Where L13 is a distance measured along the peripheral surface of the transfer drum from a recording material holding position Padh for holding the recording material by the transfer drum 1 to the image transfer position Ptr where the transfer drum 1 is opposed to the photosensitive drum 3.

In the foregoing embodiments, the invention is applied to an electrophotographic color image forming apparatus. However, the present invention is applicable to an image forming apparatus such as a printer or copying machine of an electrophotographic type of various structure, or to an image forming apparatus such as a printer or copying machine of various structure of non-electrophotographic type, which comprises means for electrostatically or mechanically holding a recording material. The structure, configuration, materials of various parts, members and elements including the transfer drum, the image forming sequential operation, or the like, can be modified as desired.

In the foregoing embodiments, the sequential operations including rotational speed reduction, separation and restoration of the transfer drum after the transfer of the final image, has been carried out for the non-plain paper sheet. However, this sequential operation may preferably be carried out even if the recording material is plain paper, if the fixing speed is different from the transfer drum peripheral speed during the transfer operation (particularly when the transfer drum peripheral speed during the transfer operation is higher than the fixing speed).

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

a moveable recording material carrying member for carrying a recording material, wherein an image formed on said image bearing member is transferred onto the recording material carried on said recording material carrying member at a transfer position, said recording material carrying member having a carrying surface for carrying the recording material and a recess extending in a direction perpendicular to a movement direction of said recording material carrying member;

switching means for switching a relative position between said image bearing member and said recording material carrying member between a first relative position for transferring an image from said image bearing member onto the recording material carried on said recording material carrying member and a second relative position different from said first relative position; and control means for controlling said switching means to switch the relative position from the second relative position to the first relative position, when said recess faces to said image bearing member.

2. An apparatus according to claim 1, wherein said recess is formed adjacent a portion of said recording material carrying member carrying a leading edge of the recording material.

3. An apparatus according to claim 1, wherein said switching means imparts the separating relative movement after an image transfer operation.

4. An apparatus according to claim 1, further comprising fixing means for fixing an image on a recording material while feeding it at a fixing speed, wherein a recording material feeding speed of said recording material carrying member is switched from a first speed which is different from said fixing speed to a second speed which is substantially equal to the fixing speed, after image transfer operation, and wherein said switching means prevents contact between the recording material and said image bearing member at least while the recording material is moving through the transfer position after the transfer operation.

5. An apparatus according to claim 1 or 4, wherein when said switching means imparts the approaching relative movement, a peripheral speed of said recording material carrying member is is substantially equal to a peripheral speed of said image bearing member.

6. An apparatus according to claim 4, wherein the second speed is smaller than the first speed.

7. An apparatus according to claim 6, wherein the fixing speed is switcheable between a third speed which is higher than the second speed and a fourth speed which is substantially equal to said second speed.

8. An apparatus according to claim 7, wherein the fixing speed is selected to be the third speed when the recording material is plain paper, and said fourth speed is selected when the recording material is non-standard sheet.

9. An apparatus according to claim 8, wherein the non-standard sheet is a transparent resin sheet.

10. An apparatus according to claim 8, wherein L1<L4 is satisfied where L4 is a distance from a position where a trailing edge of the non-standard sheet is carried to a position of said recess, measured in a direction of movement of said recording material carrying member, and L1 is a distance from the transfer position to a separating position where the recording material is separated from said recording material carrying member, measured in said direction.

11. An apparatus according to claim 8, wherein L2>L0 is satisfied where L0 is a maximum length of the non-standard sheet usable with said apparatus, and L2 is a distance, measured in a direction of movement of said recording material carrying member, from a separating position where the recording material is separated from said recording material carrying member to the transfer position.

12. An apparatus according to claim 8, wherein when said switching means imparts the approaching relative movement, a peripheral speed of said recording material carrying member is is substantially equal to a peripheral speed of said image bearing member.

13. An apparatus according to claim 8, wherein when a first image transfer operation and a second image transfer operation are continuously carried out, said switching means imparts the separating relative movement after the first image transfer operation and before the second image transfer operation, and a latent image is formed on said image bearing member after said switching means establishes said position for image formation.

14. An apparatus according to claim 1, wherein when a first image transfer operation and a second image transfer operation are continuously carried out, said switching means imparts the separating relative movement after the first image transfer operation and before the second image transfer operation, and a latent image is formed on said image bearing member after said switching means establishes said position for image formation.

15. An apparatus according to claim 1, wherein the images having different colors are superposedly transferred onto the recording material carried on said recording material carrying member.

16. An apparatus according to claim 15, wherein said apparatus is capable of forming a full-color image on the recording material.

17. An apparatus according to claim 1, wherein said recording carrying member includes a base member, a recording material carrying layer for carrying the recording material, and an elastic layer between the base member and the carrying layer.

18. An image forming apparatus, comprising:

an image bearing member;

a recording material carrying member for carrying a recording material, wherein an image formed on said image bearing member is transferred onto the recording material carried on said recording material carrying member at an image transfer position;

fixing means for fixing the image on the recording material while feeding the recording material at a fixing speed;

moving means for imparting approaching and separating relative movement between said image bearing member and said recording material carrying member;

wherein a recording material feeding speed of said recording material carrying member is switched from a first speed which is different from said fixing speed to a second speed which is substantially equal to the fixing speed, after an image transfer operation, and wherein said moving means prevents contact between the recording material and said image bearing member at least while the recording material is moving through the transfer position after the transfer operation;

wherein when said moving means imparts the approaching relative movement, peripheral speeds of said recording material carrying member and said image bearing member are substantially equal immediately before contact between said recording material carrying member and said image bearing member.

19. An apparatus according to claim 18, wherein the second speed is smaller than the first speed.

20. An apparatus according to claim 19, wherein the fixing speed is switcheable between a third speed which is higher than the second speed and a fourth speed which is substantially equal to said second speed.

21. An apparatus according to claim 20, wherein the fixing speed is selected to be the third speed when the recording material is plain paper, and said fourth speed is selected when the recording material is non-standard sheet.

22. An apparatus according to claim 21, wherein the non-standard sheet is a transparent resin sheet.

23. An apparatus according to claim 21, wherein $L2>L0$ is satisfied where L0 is a maximum length of the non-standard sheet usable with said apparatus, and L2 is a distance, measured in a direction of movement of said recording material carrying member, from a separating position where the recording material is separated from said recording material carrying member to the transfer position.

24. An apparatus according to claim 20, wherein when said moving means imparts the approaching relative movement, a peripheral speed of said recording material carrying member is a fifth speed which is substantially equal to a peripheral speed of said image bearing member.

25. An apparatus according to claim 24, wherein $L3 \geqq d1+L0$ is satisfied, where L3 is a distance, measured in a direction of movement of said recording material carrying member, from a separating position where the recording material is separated from said recording material carrying member to a position where a leading edge of the recording material is carried, L0 is a maximum length of the non-standard sheet usable with said apparatus measured in said direction, and d1 is a distance of peripheral movement of said recording material carrying member while said recording material is being changed from said second speed to said fifth speed.

26. An apparatus according to claim 18, wherein when a first image transfer operation and a second image transfer operation are continuously carried out, said moving means imparts the separating relative movement after the first image transfer operation and before the second image transfer operation, and a latent image is formed on said image bearing member after said moving means establishes said position for image formation.

27. An apparatus according to claim 18, wherein the images having different colors are superposedly transferred onto the recording material carried on said recording material carrying member.

28. An apparatus according to claim 27, wherein said apparatus is capable of forming a full-color image on the recording material.

29. An apparatus according to claim 18, wherein a latent image is formed on said image bearing member and is developed by a developer, and wherein when said moving means imparts the approaching relative movement, a portion of said image bearing member at the transfer position has the developer deposited thereon beforehand.

30. An apparatus according to claim 18, wherein said recording carrying member includes a base member, a recording material carrying layer for carrying the recording material, and an elastic layer between the base member and the carrying layer.

31. An image forming apparatus comprising:

an image bearing member, wherein a latent image is formed on said image bearing member;

a recording material carrying member for carrying a recording material, wherein an image formed on said image bearing member is transferred onto the recording material carried on said recording material carrying member at an image transfer position;

fixing means for fixing the image on the recording material while feeding the recording material at a fixing speed;

moving means for imparting approaching and separating relative movement between said image bearing member and said recording material carrying member;

wherein a recording material feeding speed of said recording material carrying member is switched from a first speed which is different from said fixing speed to a second speed which is substantially equal to the fixing speed, after an image transfer operation, and wherein said moving means prevents contact between the recording material and said image bearing member at least while the recording material is moving through the transfer position after the image transfer operation;

wherein after said moving means imparts the approaching relative movement, said latent image is formed on said image bearing member.

32. An apparatus according to claim 31, wherein when a first image transfer operation and a second image transfer operation are continuously carried out, said moving means imparts the separating relative movement after the first image transfer operation and before the second image transfer operation.

33. An apparatus according to claim 32, wherein the first image transfer operation and the second image transfer operation are effected to different recording materials.

34. An apparatus according to claim 31, wherein the second speed is smaller than the first speed.

35. An apparatus according to claim 34, wherein the fixing speed is switcheable between a third speed which is higher than the second speed and a fourth speed which is substantially equal to said second speed.

36. An apparatus according to claim 35, wherein the fixing speed is selected to be the third speed when the recording material is plain paper, and said fourth speed is selected when the recording material is non-standard sheet.

37. An apparatus according to claim 36, wherein the non-standard sheet is a transparent resin sheet.

38. An apparatus according to claim 36, wherein L2>L0 is satisfied where L0 is a maximum length of the non-standard sheet usable with said apparatus, and L2 is a distance, measured in a direction of movement of said recording material carrying member, from a separating position where the recording material is separated from said recording material carrying member to the transfer position.

39. An apparatus according to claim 36, wherein $$L11-(L0+\delta L)>L12,$$

where L0 is a maximum length of the non-standard sheet usable with said apparatus, measured in a direction of movement of said recording material carrying member, δL is a distance through which a periphery of said recording material carrying member moves while said moving means is imparting the relative movement to establish the position for image formation, L11 is a distance from a separating position where the recording material is separated from said recording material carrying member to the transfer position, and L12 is a distance from a latent image forming position to the transfer position measured in said direction.

40. An apparatus according to claim 39, wherein a distance L13 which is a distance, measured in said direction, from a position on said recording material carrying member where a leading edge of the recording material is carried to the transfer position, satisfies:

$$L11-(L0+\delta L)=L13.$$

41. An apparatus according to claim 31, wherein the images having different colors are superposedly transferred onto the recording material carried on said recording material carrying member.

42. An apparatus according to claim 41, wherein said apparatus is capable of forming a full-color image on the recording material.

43. An apparatus according to claim 31, wherein said recording carrying member includes a base member, a recording material carrying layer for carrying the recording material, and an elastic layer between the base member and the carrying layer.

* * * * *

UNITED STATES PATENT AND TRADEMARK OFFICE

CERTIFICATE OF CORRECTION

PATENT NO. : 5,523,829

DATED : June 4, 1996

INVENTOR(S) : TOSHIAKI MIYASHIRO, ET AL.

It is certified that error appears in the above-indentified patent and that said Letters Patent is hereby corrected as shown below:

Column [56] RC,
line FPD, "delete "2558615A 7/1986 Germany", "63023174 6/1976 Japan" should read --63-23174 6/1988 Japan--, "1248171 10/1989 Japan" should read --1-248171 10/1989 Japan, and "4001670 1/1992 Japan" should read --4-1670 1/1992 Japan--.

Column 5,
line 58, "charger 13" should read --chargers 13--.

Column 10,
line 19, "drum i" should read --drum 1--.

Column 13,
line 29, "switcheable" should read --switchable--.

Column 15,
line 53, "drum i" should read --drum 1--.

Column 16,
line 48, "drum i" should read --drum 1--.

Column 17,
line 2, "inequation" should read --equation--;
line 20, "inequation" should read --equation--; and
line 47, "has" should read --have--.

Column 18,
line 37, "is is" should read --is--;
line 42, "switcheable" should read --switchable--; and
line 48, "is" should read --is a--.

UNITED STATES PATENT AND TRADEMARK OFFICE

CERTIFICATE OF CORRECTION

PATENT NO. : 5,523,829

DATED : June 4, 1996

INVENTOR(S) : TOSHIAKI MIYASHIRO, ET AL.

It is certified that error appears in the above-indentified patent and that said Letters Patent is hereby corrected as shown below:

Column 19,
line 2, "is is" should read --is--;
line 40, "speed;" should read --speed; and--; and
line 63, "switcheable" should read --switchable--.

Column 20,
line 63, "speed;" should read --speed; and--.

Column 21,
line 25, "switcheable" should read --switchable--.

Signed and Sealed this

Fifteenth Day of October, 1996

*Attest:*

Bruce Lehman

BRUCE LEHMAN

*Attesting Officer*

*Commissioner of Patents and Trademarks*